US009080438B1

(12) United States Patent
McCoy et al.

(10) Patent No.: US 9,080,438 B1
(45) Date of Patent: Jul. 14, 2015

(54) WIRELESS WELL FLUID EXTRACTION MONITORING SYSTEM

(76) Inventors: James N. McCoy, Wichita Falls, TX (US); Dieter J. Becker, Wichita Falls, TX (US); Daraius K. Hathiram, Austin, TX (US)

( * ) Notice: Subject to any disclaimer, the term of this patent is extended or adjusted under 35 U.S.C. 154(b) by 584 days.

(21) Appl. No.: 13/437,125

(22) Filed: Apr. 2, 2012

(51) Int. Cl.
*E21B 47/18* (2012.01)

(52) U.S. Cl.
CPC ..... *E21B 47/18* (2013.01)

(58) Field of Classification Search
None
See application file for complete search history.

(56) References Cited

U.S. PATENT DOCUMENTS

| | | | | |
|---|---|---|---|---|
| 3,343,409 | A | 9/1967 | Gibbs | |
| 3,410,137 | A * | 11/1968 | Slover, Jr. et al. | 73/152.38 |
| 3,527,094 | A | 9/1970 | Yew et al. | |
| 4,934,186 | A | 6/1990 | McCoy | |
| 5,117,399 | A | 5/1992 | McCoy et al. | |
| 5,182,946 | A * | 2/1993 | Boughner et al. | 73/152.62 |
| 5,285,388 | A * | 2/1994 | McCoy et al. | 702/12 |
| 5,406,482 | A | 4/1995 | McCoy et al. | |
| 5,464,058 | A | 11/1995 | McCoy et al. | |
| 5,589,633 | A | 12/1996 | McCoy et al. | |
| 6,176,682 | B1 * | 1/2001 | Mills | 417/18 |
| 6,343,656 | B1 * | 2/2002 | Vazquez et al. | 166/373 |
| 6,634,426 | B2 * | 10/2003 | McCoy et al. | 166/254.1 |
| 6,857,474 | B2 | 2/2005 | Bramlett et al. | |
| 8,615,374 | B1 * | 12/2013 | Discenzo | 702/127 |
| 2001/0021347 | A1 * | 9/2001 | Mills | 417/18 |
| 2002/0084071 | A1 * | 7/2002 | McCoy et al. | 166/255.1 |
| 2005/0033485 | A1 * | 2/2005 | Nimmo et al. | 701/1 |
| 2005/0270904 | A1 * | 12/2005 | Finnestad et al. | 367/83 |
| 2006/0028335 | A1 * | 2/2006 | Glenn et al. | 340/531 |
| 2007/0135179 | A1 * | 6/2007 | Hardman et al. | 455/574 |
| 2007/0139209 | A1 * | 6/2007 | Butalla et al. | 340/621 |
| 2008/0013696 | A1 * | 1/2008 | Motley et al. | 379/45 |
| 2008/0143512 | A1 * | 6/2008 | Wakisaka et al. | 340/504 |
| 2009/0252306 | A1 * | 10/2009 | Bates et al. | 379/88.18 |
| 2009/0271680 | A1 * | 10/2009 | Tanigawa et al. | 714/748 |
| 2010/0188206 | A1 * | 7/2010 | Kates | 340/521 |
| 2010/0302902 | A1 * | 12/2010 | Nance et al. | 367/21 |
| 2011/0038252 | A1 * | 2/2011 | Chung et al. | 370/216 |
| 2012/0020445 | A1 * | 1/2012 | DiStasi et al. | 375/355 |
| 2012/0020808 | A1 * | 1/2012 | Lawson et al. | 417/18 |
| 2012/0203491 | A1 * | 8/2012 | Sun et al. | 702/108 |

FOREIGN PATENT DOCUMENTS

JP 10172074 A * 6/1998

OTHER PUBLICATIONS

Rowlan et al., Gas Wll De-Lquidfication Workshop, Mar. 5-7, 2007.*

* cited by examiner

*Primary Examiner* — Brian Zimmerman
*Assistant Examiner* — Kevin Lau
(74) *Attorney, Agent, or Firm* — Dan Brown Law Office; Daniel R. Brown

(57) ABSTRACT

A system for wirelessly monitoring a well fluid extraction process, which operates in conjunction with a host computer. The system includes a wireless base that has a base radio and a communication port to interface with the host computer. The system also has a first remote with a first remote radio that communicates with the base radio using a radio protocol. The first remote also has a first sensor interface that can receive a first sensor signal. The first remote digitally samples the first sensor signal at a predetermined sampling rate, and then communicates first sampled data to the wireless base through the radio protocol. A host software application, which executes on the host computer, receives the first sampled data from the wireless base communication port.

21 Claims, 10 Drawing Sheets

WIRELESS WELL FLUID EXTRACTION MONITORING SYSTEM

BACKGROUND OF THE INVENTION

1. Field of the Invention

The present invention relates to monitoring the operation and performance of fluid extraction equipment and processes from a subterranean well. More particularly, the present invention relates to systems for wirelessly monitoring dynamic performance in a sucker-rod pumped hydrocarbon well.

2. Description of the Related Art

Some wells utilize a pumping system to extract oil, gas, and water from subterranean well boreholes. Other wells rely on natural reservoir pressure, including gas pressure to extract fluids. A pumping system typically comprises a surface mounted reciprocating drive unit coupled to a submerged pump by a long steel rod, referred to as a sucker-rod. The submerged pump consists of a chamber, plunger, and a pair of check valves arranged to draw fluids into the chamber and lift fluids to the surface on each upstroke of the plunger. Wells that primarily produce gas can employ a cyclical plunger in a plunger lift arrangement that employs pressure differentials to purge liquids to the surface. Since wells range in depths to many thousand feet, the forces and pressures involved in the pumping operation are substantial. The costs of drilling, assembling, and servicing such wells are also substantial. Costs are only offset by efficient production of oil and gas products from the well. Thus, the careful attention given by operators to efficient and reliable operation of sucker-rod pumped wells over many decades of experience can be readily appreciated.

Well operators can directly access and monitor surface mounted well equipment performance by attaching certain sensors and transducers and analyzing the data they produce. It is also desirable for operators to monitor reservoir performance, however, this information is not readily accessible from the surface equipment, so specialized sensors and processing equipment are required. Wells typically employ a wellhead assembly at the top of the well borehole to seal the well fluids within a surface plumbing system. A reciprocating sucker-rod enters the wellhead assembly through a sliding seal, which requires that the rod be terminated at the surface level by a polished portion, commonly referred to as a polished rod. In a typical well, an electric motor drives the polished rod up and down through a mechanical drive arrangement. Thus, at the surface, the well equipment is accessible for operators to monitor the movement and forces on the polished rod, the power consumption characteristics of the electric drive unit, and also the pressures and temperatures in surface plumbing and the wellhead itself. In addition, the well casing and tubing string in the well borehole are accessible at the surface level. The tubing string is typically filled with well liquids and the annulus between the tubing string and the well casing are typically filled with gases down to a liquid level in the vicinity of the fluid producing geological formation, which may be thousands of feet below the surface. It is useful for operators to know the depth of this liquid level as well as certain other fluid and mechanical characteristics within the well bore. Liquid level measurements and other subterranean casing data can be gathered from the surface level using an acoustic pulse and echo sounding equipment.

Certain instruments for gathering well performance data are known in the art. Among these are movement sensors and force sensors that are connected to the reciprocating pump mechanism. Others include electric current and voltage sensors connected to the pump drive motor, tubing and casing pressure transducers, temperature probes, as well as the aforementioned acoustic sounding devices, sometimes referred to as an "echometer". In the prior art, most of these sensors are utilized in a portable manner, being carried from well to well by technicians as they conduct various performance tests at various well sites. The prior art patents cited below give the reader a substantial background on the types of sensors and transducers used by operators and technicians. Note that a common characteristic in these disclosures is the use of wires and cables to interconnect between the sensors and a central processing unit, such as a PC computer. While electrical cables are a useful solution for interconnecting sensors and data processing devices during well testing activities, they have certain issues. First, since they must be built to rugged industrial standards, they are expensive. Cables are prone to electric and stress failures, particularly after frequent and repeated connection, storage, and reconnection cycles. They also tend to collect dirt and oil, which degrades their utility over time. It is also relatively time consuming for technicians to deploy, connect, and stow cables as they move from well to well. In addition, cables assembles are both heavy and bulky.

Significant advancements in equipment and techniques for gathering and processing surface data and generating downhole data have been contributed by McCoy et al., and are presented in a series of patents, the teachings of which are hereby incorporated by reference. The use of an accelerometer and strain gauge in a polished rod transducer to implement a surface dynamometer have been taught. The accelerometer advancements are presented in U.S. Pat. No. 5,406,482 to McCoy et al., issued Apr. 11, 1995, for METHOD AND APPARATUS FOR MEASURING PUMPING ROD POSITION AND OTHER ASPECTS OF A PUMPING SYSTEM BY USE OF AN ACCELEROMETER, which teaches that an accelerometer is mounted on the pumping system unit to move in conjunction with the polished rod. An output signal from the accelerometer is digitized and provided to a portable computer. The computer processes the digitized accelerometer signal to integrate it to first produce a velocity data set and second produce a position data set. Operations are carried out to process the signal and produce a position trace with stroke markers to indicate positions of the rod during its cyclical operation.

The McCoy et al. advancements in the use of a strain gauge in a surface dynamometer are presented in U.S. Pat. No. 5,464,058 to McCoy et al, issued Nov. 7, 1995, for METHOD OF USING A POLISHED ROD TRANSDUCER, which teaches that a transducer is attached to the polished rod to measure deformation, i.e., the change in diameter or circumference of the rod to determine changes in rod loading. The transducer includes strain gauges, which produce output signals proportional to the change in the diameter or circumference of the rod, which occurs due to changes in load on the rod. The transducer may also include an accelerometer. The change in load on the polished rod over a pump cycle is used in conjunction with data produced by the accelerometer to calculate a down-hole pump card according to the teachings of in the prior art cited herein. The pump card showing changes in pump load is adjusted to reflect absolute rod load by determining an appropriate offset. Various ways to determine the offset are available. Since the pump plunger load is zero on the down stroke when the upper check valve, called the traveling valve, is open, the value necessary to correct the calculated minimum pump value to a zero load condition may be used as the offset. The offset can also be estimated by either a calculation of the rod weight, a predetermined rod weight measurement or an estimated load value by the operator. The teachings of the '058 are hereby incorporated by reference.

A typical well is built by drilling a borehole and installing a well casing. A tubing string is lowered into the well casing. The well fluids are pumped to the surface by a pump at the bottom, through the tubing string. Thus, there exists an annular space between the casing and the tubing. The well fluids are present in this space, and it is useful to know the liquid level of the well fluids to better understand well operations and to improve accuracy of certain measurements and calculations. In this regard, McCoy et al. have also provided further advancements in the art of measuring well casing and tubing liquid levels. These teachings are presented in U.S. Pat. No. 5,117,399 to McCoy et al., issued May 26, 1992, for DATA PROCESSING AND DISPLAY FOR ECHO SOUNDING DATA, which is directed to an echo sounding system with a acoustic gun that is mounted to the wellhead of a borehole casing. The acoustic gun produces an acoustic pulse that is transmitted down the casing or tubing. The acoustic pulse produces reflections when it strikes the tubing collars and the surface of the well fluid. A microphone detects the reflections to produce a return signal. This signal is digitized and stored. The teachings of the '399 patent are hereby incorporated by reference.

A further advancement in the use of echo sounding equipment, referred to as an "echometer", is taught by McCoy et al, in U.S. Pat. No. 6,634,426, issued Oct. 21, 2003, for DETERMINATION OF PLUNGER LOCATION AND WELL PERFORMANCE PARAMETERS IN A BOREHOLE PLUNGER LIFT SYSTEM. The teachings of this patent are hereby incorporated by reference. This patent provides a method for measuring well performance in the case of a gas producing well that employs a pressure operated plunger lift apparatus to clear fluids out of the well, and the use of an echometer to evaluate plunger and well performance. In another patent by McCoy, and automatic echometer is taught, and this is U.S. Pat. No. 4,934,186, issued Jun. 19, 1990, for AUTOMATIC ECHO METER. This patent teaches an apparatus that enables continuous calculations of the depth of the fluid level within a well bore during a test interval. A sonic event is generated in the well bore, and the reflected sonic signals from down hole tubing collars and the fluid surface are sensed and recorded. By knowing the depth of the tubing collars, the fluid depth and speed of sound in the overlying gas can be computed. Subsequently, the apparatus generates sonic events and records the travel time for the sound to reflect off the fluid surface and return. Measurements of the actual fluid depth and sonic velocity are made at regular intervals, and interpolated between actual measurements to allow the variation in fluid level to be calculated from the measurements of travel time. The teachings of the '186 patent are hereby incorporated by reference.

Thus, is can be appreciated that there is a need in the art for a system and method for use in plunger lift and sucker-rod pumped oil and gas well industry that further assists operators and technicians in more efficiently performing on-site well performance testing and analysis.

SUMMARY OF THE INVENTION

The need in the art is addressed by the systems and methods of the present invention. The present disclosure teaches a system for wirelessly monitoring a well fluid extraction process, which operates in conjunction with a host computer. The system includes a wireless base that has a base radio and a communication port to interface with the host computer. The system also has a first remote with a first remote radio that communicates with the base radio using a radio protocol. The first remote also has a first sensor interface that can receive a first sensor signal, which corresponds to performance metrics of the well fluid extraction process. The first remote digitally samples the first sensor signal at a predetermined sampling rate, and then communicates first sampled data to the wireless base through the radio protocol. A host software application, which executes on the host computer, receives the first sampled data from the wireless base communication port, and processes the performance metrics to output well fluid extraction performance data.

In a specific embodiment of the foregoing system, the first remote further includes a second sensor interface that receives a second sensor signal. The first remote digitally samples the second sensor signal at a second predetermined sampling rate, and then communicates second sampled data to the wireless base through the radio protocol. The host software application also receives the second sampled data from the wireless base communication port. In a refinement to this embodiment, the predetermined sampling rate and the second predetermined sampling rate are periodically synchronized, including the time at which sampling is initiated. In another refinement to this embodiment, where the system is monitoring the performance of a sucker rod pump in the well fluid extraction process, the system further includes an accelerometer coupled to the first sensor interface, which outputs the first sensor signals representative of the instant acceleration of the sucker rod. It also includes a strain gauge coupled to the second sensor interface, which outputs the second sensor signals indicative of the instant load of the sucker rod, and then the host software application utilizes the first sampled data and the second sampled state to generate a dynamometer dynagraph.

In a specific embodiment, where the foregoing system is for use with a well fluid extraction process that employs plunger lift liquid removal that operates with respect to casing annulus pressure, tubing pressure, and liquid level, the system further includes a third sensor interface that receives a third sensor signal, which is digitally sampled to wirelessly communicate third sampled data to the wireless base. The host software application then receives the third sampled data from the wireless base communication port and uses it to analyze plunger lift performance of the well fluid extraction process. In a further refinement, the system includes a first sensor couple to acoustically detect the liquid level in the well fluid extraction process and output the first sensor signal, and a second sensor coupled to detect the casing annulus pressure in the well fluid extraction process and output the second sensor signal, and also a third sensor coupled to detect the tubing pressure in the well fluid extraction process and output the third sensor signal. In another refinement, the first sampled data, the second sampled data, and the third sampled data are processed by the host software application to determine plunger location in the well fluid extraction process, the plunger lift well performance, or the plunger cycle times.

In a specific embodiment of the foregoing system, the first remote further includes a first sensor for gathering first performance information for the well fluid extraction process, which is coupled to provide the first sensor signal to the first sensor interface. In a refinement to this embodiment, the first sensor is selected from amongst a pressure transducer, a temperature transducer, an accelerometer, a strain gauge, a voltage transducer, an electric current transducer, a position transducer, and a microphone. In another refinement, the first sensor is calibrated according to a first calibration coefficient stored in the first remote, and the first wireless remote transfers the first calibration coefficient to the wireless base through the radio protocol in response to a command. The command may be generated by the host software application and communicated to the first remote through the radio protocol. In another embodiment, the well fluid performance data is selected from a surface dynagraph, a down-hole pump dynagraph, a pump animation, a drive torque analysis, a mechanical loading analysis, and structure dynamics analysis.

In a specific embodiment of the foregoing system, the predetermined sampling rate is programmable by the host software application, and is communicated to the first remote through the wireless base using the radio protocol. In another specific embodiment, the system further includes a unique identification code stored in the first remote, and, the unique identification code is transferred to the wireless base through the radio protocol, and then, the first remote is subsequently addressed according to the unique identification code by the wireless base and the host software application.

In a specific embodiment of the foregoing system, the base radio and the first remote radio are frequency agile between a configuration radio channel and data transfer radio channel. The first remote operates on the configuration radio channel by default and then changes to the data transfer radio channel upon receipt of a channel command from the wireless base, and the host software application may initiate the channel command in the wireless base. In a refinement to this embodiment, the first remote periodically transmits an identity beacon that contains a unique identification code for the first remote, and, the wireless base adds the unique identification code to a list of remote unique identification codes, and then transfers the list of remote unique identification codes to the host software application, making the host software application aware of the first remote, as well as any other remotes.

In a specific embodiment of the foregoing system, the wireless base transmits a synchronization signal at predetermined intervals, and the first remote employs the synchronization signal as a timing reference to the predetermined sampling rate. In a refinement to this embodiment, the synchronization signal is referenced to a hardware timing circuit in the wireless base, which eliminates timing jitter and timing drift in the clock, which may be caused by software latency or clock instability. In another refinement to this embodiment, the predetermined intervals are programmable by the host software application.

In another refinement to the prior embodiment, the synchronization signals establish timing frames for transmission of the first sampled data from the first remote to the wireless base. This is further refined where the first sampled data is transmitted in a data slot within the timing frames this is defined by an offset time from the synchronization signal and a duration time. Further, the timing frames may include a portion for the communication of base commands from the wireless base to the first wireless remote, and a portion for the communication of remote commands from the first remote to the wireless base.

In a specific embodiment of the foregoing system, the radio protocol establishes timing frames having a data portion for the transmission of the first sampled data, and a base portion for the transmission of base commands from the wireless base to the first wireless remote, and a remote portion for the communication of remote commands from the first remote to the wireless base. The base commands and remote commands can be used to implement additional embodiments.

In a specific embodiment of the foregoing system the system can take acoustic echo readings through a well bore coupling in a well bore of the well fluid extraction process. This embodiment further includes an acoustic gun assembly with a gas pressure reservoir that is to selectively release a shock wave of gas pressure to a well bore interface port. It also has a microphone acoustically coupled to the well bore interface port. The microphone is coupled to the first sensor interface to provide the first sensor signal. The first remote further includes a solenoid drive interface coupled to the solenoid. The first remote, in relation to a release of a shock wave of gas pressure, communicates the first sensor signal representative of acoustic reflections within the well bore, which are digitally sampled according to the predetermined sampling rate and communicated to the wireless base in the data portion of the timing frames, and the host software application detects the shock wave of gas pressure to establish a reference time for the acoustic echo readings. In a refinement to the previous embodiment, the acoustic gun further includes a solenoid valve coupled to selectively release the shock wave of gas pressure in response to a fire command from the host software application.

In a refinement to the previous embodiment, the host software application allocates a first fraction of time from the data portion of the timing frames for the transmission of the first sampled data according to a total number of remotes, including the first remote, and also according to the predetermined sampling rate, and then the first remote transmits the first sampled data within the first fraction of time. In a refinement to this embodiment, the radio protocol further includes an error detection protocol, and the wireless base requests retransmission of the first sampled data when an error is detected, and then the first remote retransmits the first sampled data within that first fraction of time. In yet another refinement, the host software application divides the data portion of the timing frames into plural remote data slots, and assigns a first remote data slot to the first remote for the transmission of the first sampled data.

In another refinement to the previous embodiment, the first remote includes a first actuator coupled to the first remote radio, and then, actuation of the actuator causes the remote radio to transmit an actuation command to the wireless base within the remote portion of the timing frames. In an improvement to this embodiment, the actuation command is coupled from the wireless base to the host software application and causes the host software application to initiate a sequence of actions to begin acquisition and processing of sensor data from the well fluid extraction process.

In a specific embodiment of the foregoing system, the first remote includes a visual indicator coupled to the first remote radio. The first remote is responsive to receipt of a base command received in the base portion of the timing frames to activate the visual indicator, and also the base command may originate in the host software application.

In a specific embodiment of the foregoing system, the host software application generates host commands that are coupled by the communication port to the wireless base, and, a portion of the host commands are translated to base commands from subsequent transmission to the first remote. In a refinement to this embodiment, the wireless base is responsive to a host command to configure the wireless base to accumulate the first sampled data for a period of time after the communication port is disconnected from the host computer. In another refinement, the host commands include a command for the first remote to begin, and a command for the first remote to terminate, the digital sampling and communication of the first sampled data. In another refinement, the host commands include a command to define the timing and duration of the data portion, the base portion, and the remote portion of the timing frames. And, in yet another refinement, the host commands include a command to define the predetermined sampling rate.

In a specific embodiment of the foregoing system, where the wireless base further includes a GPS receiver, the wireless base returns a present set of GPS coordinates to the host software application upon command. In another specific embodiment, the radio protocol employs the IEEE 802.15.4 physical layer specification.

In a specific embodiment, the system further includes a second remote with a second remote radio that communicates with the base radio using the radio protocol, and that has a second sensor interface to receive a second sensor signal. The second remote digitally samples the second sensor signal at a second predetermined sampling rate to communicate second sampled data to the wireless base through the radio protocol. In a refinement to this embodiment, the wireless base transmits a synchronization signal at predetermined intervals, and the first remote employs the synchronization signal as a timing reference to the predetermined sampling rate, and the second remote employs the synchronization signal as a timing reference to the second predetermined sampling rate.

In another refinement to the previous embodiment, the predetermined sampling rate and the second predetermined sampling rate are periodically synchronized with the synchronization signal, including the time at which sampling is initiated. In another refinement, the synchronization signals establish timing frames, which includes a data portion for transmission of the first sampled data and the second sampled data to the wireless base, and also, the timing frames include a base portion for the communication of base commands from the wireless base to the first wireless remote and the second wireless remote. In a further refinement, the host software application divides the data portion of the timing frames into plural remote data slots, and assigns a first remote data slot to the first remote for the transmission of the first sampled data, and a second remote data slot to the second remote for the transmission of the second sampled data.

In a further refinement to the previous embodiment, the first data slot within the timing frames is defined by a first offset time from the synchronization signal and a first duration time, and the second data slot within the timing frames defined by a second offset time from the synchronization signal and a second duration time. In yet another refinement, the first predetermined sampling rate and the second predetermined sampling rate are independently programmable by the host software application, and are communicated to the first remote and the second remote through the wireless base using the base portion of the timing frames.

The present disclosure also teaches a wireless dynamometer for measuring performance of a sucker rod driven pump in a well fluid extraction process, which is used with a wireless enabled host computer running a host software application that generates dynamometer dynagraphs from sucker rod acceleration and load data. The wireless dynamometer includes a housing with a clamp arm for clamping onto a polished rod portion of the sucker rod so that they move together. The housing contains an accelerometer that outputs acceleration signals representative of the instant acceleration of the sucker rod, which is then coupled to a first converter that digitally samples the acceleration signals at a predetermined sampling rate to generate sampled acceleration data. A strain gauge is disposed on the clamp arm, which outputs load signals indicative of the instant load of the sucker rod, and that is coupled to a second converter that digitally samples the load signals in synchronous with the predetermined sampling rate to produce sampled load data. There is a radio that communicates with the host computer in accordance with a radio protocol, and the radio receives, and transfer to the host computer, the sampled acceleration data and the sampled load data.

In a specific embodiment of the foregoing dynamometer, the host software application conducts further analysis of the sampled acceleration data and the sampled load data to generate a graphical animation of a down hole portion of the sucker rod driven pump. In another specific embodiment, the host software application processes the sampled acceleration data and the sampled load data to calculate both a surface dynagraph and a downhole dynagraph.

The present disclosure also teaches a wireless acoustic sounding apparatus for generating an acoustic pulse and gathering return echo signals in a well bore in a well fluid extraction process, and also for use with a wireless enabled host computer. The wireless acoustic sounding apparatus includes an acoustic gun assembly that has a gas pressure reservoir gated with a solenoid valve to selectively release a pulse of gas pressure to a well bore interface port, and a solenoid drive circuit coupled to activate the solenoid valve in response to a fire command. A microphone is acoustically coupled to the well bore interface port that outputs echo signals representative of an initial acoustic pulse and subsequent acoustic reflections from the well bore, and further coupled to a converter that digitally samples the echo signals at a predetermined sampling rate to generate sampled echo data. A radio communicates with the host computer in accordance with a radio protocol that establishes timing frames having both a data portion for the transmission of the sampled echo data to the host computer, and a base portion for the receipt of commands from the host computer. The radio is coupled to the solenoid drive circuit to activate the solenoid valve upon receipt of the fire command from the host computer, thereby generating an acoustic pulse, which results in the return echo, which causes the microphone to output the echo signals. The sampled echo data is then coupled to the radio and transmitted in the data portion of the radio protocol, which thereby enables wireless reception by the host computer. In a refinement to this embodiment, the host software application utilizes the sampled echo data to calculate a pressure gradient of a gas column and a liquid column in the well bore.

In a specific embodiment of the forgoing system, the host software application utilizes the sampled echo data and the well pressure data to calculate a series of downhole pressures at a predetermined depth for a pressure transient test to analyze well performance.

The present invention also teaches a wireless dynamometer for measuring performance of a sucker rod driven pump in a well fluid extraction process, for use with a wireless enabled host computer running a host software application that generates dynamometer analysis from sucker rod acceleration and load data. The wireless dynamometer includes a housing that is connected to the sucker rod to move together therewith. An accelerometer is fixed to the housing, which outputs acceleration signals representative of the instant acceleration of the sucker rod, that are coupled to a first converter to digitally samples the acceleration signals at a predetermined sampling rate to generate sampled acceleration data. Also, a strain gauge is disposed in the housing and outputs load signals indicative of the instant load on the sucker rod, which are coupled to a second converter that digitally samples the load signals in synchronous with the predetermined sampling rate to produce sampled load data. A radio communicates with the host computer in accordance with a radio protocol, and the radio is coupled to receive, and transfer to the host computer, the sampled acceleration data and the sampled load data.

In a specific embodiment to the foregoing dynamometer, the host software application conducts analysis and processing of the sampled acceleration data and the sampled load data to generate a graphical animation of a downhole portion of the sucker rod driven pump. In another embodiment, the host software application processes the sampled acceleration data and the sampled load data to calculate a dynagraph from a selected location along the sucker rod, selected from a surface position and a downhole position.

The present invention also teaches a wireless acoustic sounding apparatus for generating an acoustic pulse and gathering return echo signals in a well bore in a well fluid extraction process, and for use with a wireless enabled host computer. The apparatus includes an acoustic gun assembly with a gas pressure reservoir that is gated with a manually operated valve to selectively release a pulse of gas pressure to a well bore interface port. A microphone is acoustically coupled to the well bore interface port and outputs echo signals representative of an initial acoustic pulse and subsequent acoustic reflections from the well bore. The microphone is also coupled to a converter that digitally samples the echo signals at a predetermined sampling rate to generate sampled echo data. A radio communicates with the wireless enabled host computer in accordance with a radio protocol for the transmission of the sampled echo data to the wireless enabled host computer. Then, the sampled echo data can be coupled to the radio and transmitted, thereby enabling wireless reception by the wireless enabled host computer.

In a specific embodiment of the foregoing acoustic sounding apparatus, the sampled data is processed by a host software application to determine a liquid level depth.

The present invention also teaches a wireless acoustic sounding apparatus for generating an acoustic pulse and gathering return echo signals in a well, which also employs a pressure transducer for gathering well pressure data in a well fluid extraction process. This apparatus includes an acoustic gun assembly with a gas pressure reservoir gated with a manual valve to selectively release a pulse of gas pressure to a well bore interface port. A microphone is acoustically coupled to the well bore interface port that outputs echo signals representative of an initial acoustic pulse and subsequent acoustic reflections from the well bore. The microphone is also coupled to a converter that digitally samples the echo signals at a predetermined sampling rate to generate sampled echo data. A pressure transducer is positioned to sense the well pressure and is coupled to a converter that digitally samples the pressure signal at a predetermined sampling rate to generate sampled pressure data. A radio communicates with the wireless enabled host computer in accordance with a radio protocol for the transmission of the sampled echo and pressure data. The, the sampled echo and pressure data are coupled to the radio and transmitted, thereby enabling wireless reception by the wireless enabled host computer. A host software application processes the sampled echo data and the sampled pressure data to obtain a casing annulus gas flow rate. In addition, the host software application may process the sampled echo data and the sampled pressure data to determine downhole pressures.

DESCRIPTION OF THE INVENTION

Figure 1:
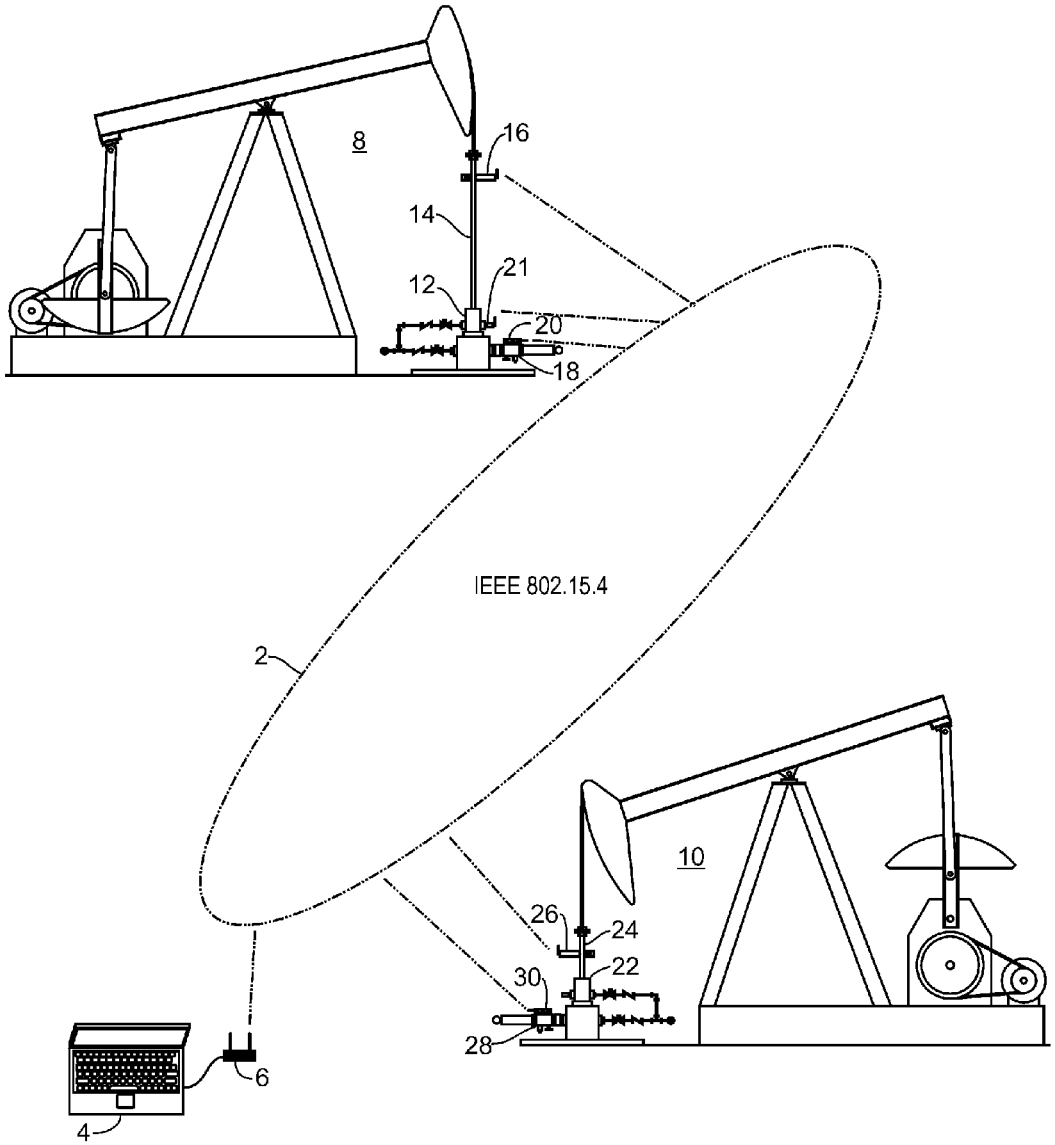
FIG. 1 is a system diagram of two oil well pumps under test using a wireless well monitoring system according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The present invention advances the art by providing a system for measuring and testing equipment and processes that operate in a well fluid extraction process using a diverse range of sensors and control functions that operate wirelessly and that address critical real-time timing and synchronization issues so as to enable accurate and reliable information processing. The system interfaces wireless remote units connected to sensors and transducers with a host software application running on a host computer, which both gathers and processes the test information, but also manages user interface, data presentation, system control and timing features of the system. The system contemplates multiple types of sensors, multiple simultaneously operating sensors, and closely related information sources, and a range of convenience feature for user interface, data management, and operation of the system. FIG. 1 presents an exemplary field environment for operation of an illustrative embodiment of the present invention.

Reference is directed to FIG. 1, which is a system diagram of two oil well pump jacks that are located in a single oil field, and which are connected to an illustrative embodiment system for conducting real-time performance tests using wireless interfaces for the test instrumentation. A first pump jack 8 and a second pump jack 10 are coupled to lift well fluids out of a first well head casing 12 and a second well head casing 22, respectively. "Pump jack" is a customary term used to describe a walking-beam type cyclical reciprocating drive for sucker-rod driven down-hole pumps. Pump jack 8 is illustrated at the top of its stroke where the polished rod 14 is drawn upward and fully extended out of the wellhead casing 12. A wireless polished rod transducer ("WPRT") 16 is temporarily clamped to the polished rod 14 and travels up and down with the rod's stroke. A radio transceiver in WPRT 16 communicates within a wireless network 2 that generally operates in compliance with the physical layer specification of I.E.E.E. protocol standard 802.15.4, although it will be appreciated that other radio protocols could be employed. In the illustrative embodiment, the wireless network operates in the 2.4 GHz band, although other radio frequency bands could also be employed. A wireless acoustic liquid level meter and pressure transducer interface 18, which is generally referred to as a wireless remote fire gun ("WRFG") because the acoustic liquid level test is initiated with a burst of gas pressure released in gun-like fashion, is pneumatically coupled to the wellhead casing 12 through a valve gated plumbing fitting. The WRFG 18 operates to initiate an acoustic echo test into the well casing and then detecting the return echo signal for further analysis. The WRFG 18 also comprises pressure transducers that sense well casing pressure. All of these signals are coupled to wireless transceiver 20, which also communicates with wireless network 2. A separate wireless pressure transducer 21 is coupled to the well tubing string to sense the tubing pressure and communicate pressure reading data into the network 2. Similarly, pump jack 10 is illustrated at the lowest position in its stroke, where the polished rod 24 is fully lowered into the well casing 22. Polished rod 24 also has a WPRT 26 temporarily attached thereto, which communicates with the wireless network 2. A second WRFG 28 with wireless transceiver 30 is attached to well head casing 22 and wirelessly communicates within the wireless network 2. In the illustrative embodiments, the protocol defines up to sixty-four data channels when operating at data sample rates of 30 HZ per channel. Higher data rates are supported, with corresponding reduction in the number of simultaneous data channels. For example, data rates as high a 4 kHz may be employed to provide high resolution of system performance where needed.

FIG. 1 illustrates a test set-up for a well site having two pumping oil wells. Such tests are run occasionally, so it is preferable for the WPRT's 16 and 26 and the WRFG's 18 and 28 to be attached to the wells on the day of the test, then removed at the end of the test, to be taken to the next well site for subsequent testing elsewhere. The data gathered during the test is coupled to a processor 4, which is typically a laptop type personal computer. The interface to the processor 4 is via a wireless base unit 6 connected to the processor through a serial port and wirelessly communicating within the wireless network 2 using the aforementioned radio protocol standard. Of course, other wireless systems and protocols could be employed with the teachings of the present invention, as will be appreciated by those skilled in the art. The wireless features of this system design are beneficial in that they eliminates the need for interconnecting cables between the host computer and the polished rod transducers and the remote fire gun. Such cables are heavy, cumbersome, subject to failure, and generally require greater effort to utilize. However, it is to be understood that the real-time measuring, processing, testing and display features of the present invention could be implemented with a system employing a mixture of wireless interfaces or wired interfaces if so desired. For example, this would be beneficial if an operator chose to gradually transition from a wired to a wireless testing system. The processor 4 functions as a host computer for the wireless system, and executes host software application programs and algorithms that enable a wide range of functions of the present invention, including gathering test measurements, transmitting and receiving control signals, managing user interface, maintaining reference database information, processing data to provide real-time results, generating graphical and alpha-numeric output data, and driving hardware devices including a display and serial port, as well as other features of the present invention discussed more thoroughly hereinafter. One aspect of the illustrative embodiment system is to select one or more wireless remotes that are within RF range of a wireless base, thereby forming a group, configure the group to select which radio and data channels to use and at what sample rates, and perform a data acquisition operation that provides a live real-time data stream accessible from the wireless base and the host computer, which can be viewed in real time or stored for later analysis. The systems also contemplates independent group formation and operation. It provides the ability to select wireless remotes and corresponding sensors and assign them to one of more groups, for example, a group for each of the wells 8, 10 in FIG. 1. Each group can be configured and instructed to perform acquisitions independent of the other group. A new group can in fact be formed while another group is already acquiring data. This is one of the reasons there are dual radios on the wireless base unit. This concept can be extended to have additional groups with additional radios on the base.

In the case of a single wireless base operating with a single group of wireless remotes, an illustrative embodiment is arranged as follows. The wireless remotes have three operating states; standby (transmitting a slow beacon), awake (transmitting a fast beacon), and acquire. Wireless remotes power up into the standby state. In this state they operate on an assigned configuration radio channel and transmit a short beacon at periodic intervals programmable in the range from 2 to 30 seconds. Between beacons the wireless remotes remains in a very low power state to conserve batteries. A beacon communicates the wireless remote identification and state (identification, model number, battery state, and etc. Each wireless remote transitions to the awake state if it receives a suitable response from a wireless base indicating that the base intends to utilize it. During the awake state, the wireless remote transmits its beacons more frequently (0.1 to 1 sec). Operation remains on the configuration radio channel. During this state the base can configure the wireless remote. This includes setting which channels will be used for an acquisition, at what sample rate, gain, and data format. The wireless remote is also assigned a group number, which defines the data radio channel, and a timeslot during which it must transmit its data during acquisition. During this time the base must always await a beacon to initiate a communication with the wireless remote. Each wireless remote transitions to the Acquire state in a two-step sequence. It must receive an acquire command from the base. It must acknowledge this command and then switch to the data radio channel in receive mode. If a StartSync command is received, this triggers the start of data acquisition. The wireless powers up and begins to listen for wireless remote beacons on the configuration radio channel. A host software application, running on the host computer attached to the base, retrieves and maintains a list of audible wireless remotes. The host can then instruct the base to configure a subset of wireless remotes. The host provides all of the configuration information, however, the configuration information can be stored in the base and utilized during a stand-alone mode of operation. A start command from the host, or the base, sets off the sequence that transitions the selected wireless remotes to data acquisition mode. In the illustrative embodiment, the wireless remote states transition backwards into standby either based on timeouts or when instructed by the base.

Figure 2:
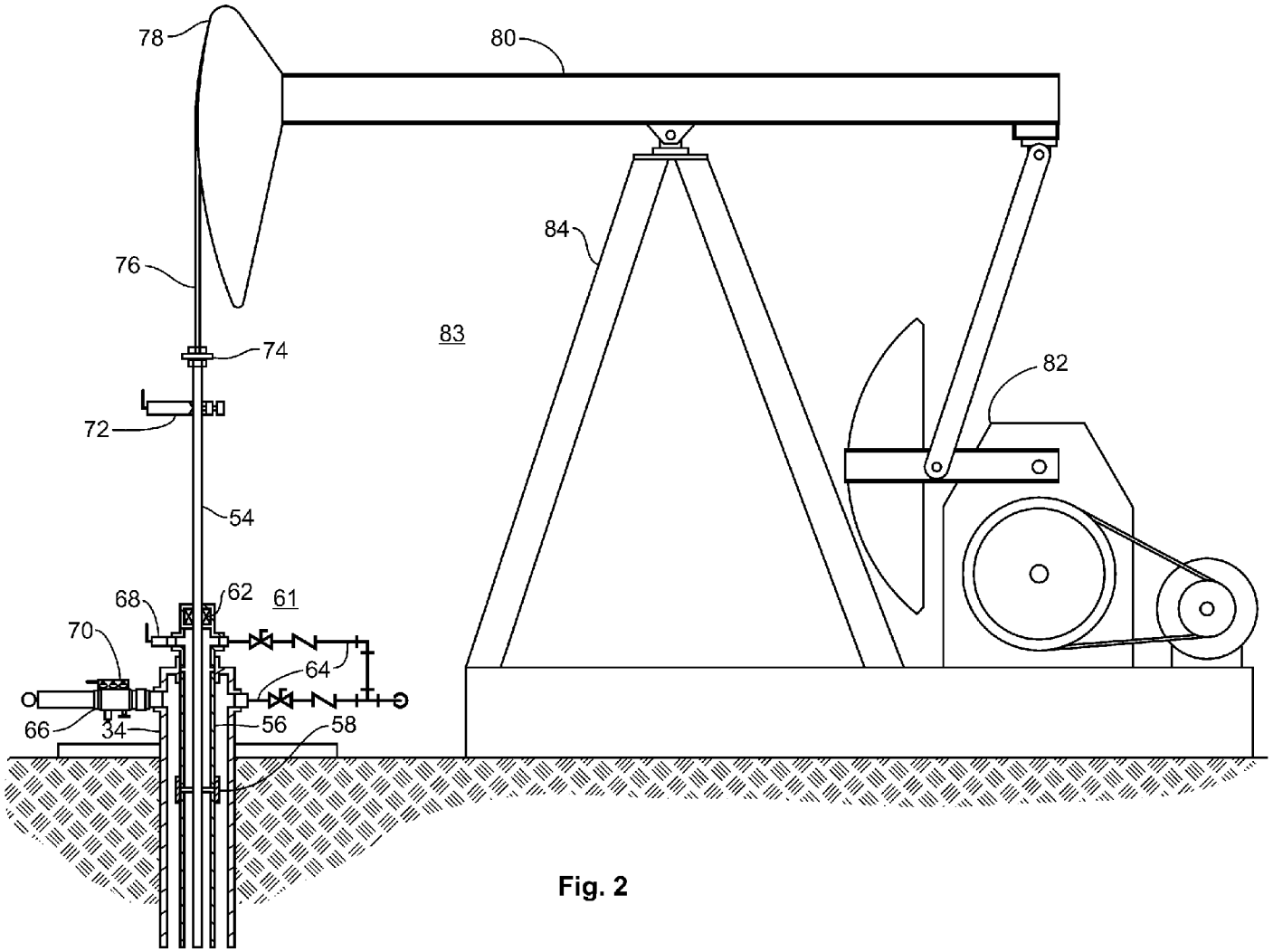
FIG. 2 is a drawing of an oil well reciprocating drive unit employing a wireless well monitoring system according to an illustrative embodiment of the present invention.

Reference is directed to FIG. 2, which is a drawing of a surface mounted reciprocating pump drive 83 coupled to a wellhead casing 61 under test according to an illustrative embodiment of the present invention. The top of well is terminated by a well head assembly 61 consisting of a casing head and pumping tee, which couples to the top of the well casing 34 and the top of the tubing string 56. The sucker rod 54 passes through the well head casing 61, and a gland seal 62 is used to seal gases and liquids from the ambient environment. The top portion of the sucker rod 54 is polished to maintain a tight seal, and is thusly referred to as the polished rod. The liquids and gases produced by the well 32 are routed to processing and storage equipment (not shown) by a plumbing system 64. An acoustic echometer 66 is pneumatically coupled to the annulus between the interior of the casing 34 and the exterior of the tubing string 56. An acoustic shock wave is released into the annulus, and the resulting echo is detected by the acoustic liquid level meter 66, which is used to measure the actual liquid level down hole and other useful data. A wireless remote transceiver 70 is used to communicate with the echometer 66. The echometer 66 also includes a pressure sensor that detects the casing pressure at the surface level. In addition a tubing string pressure sensor 68 is coupled to the interior cavity of the tubing string 56 to detect the pressure therein, and also wirelessly communicates within the aforementioned wireless network. The well itself is built by drilling a borehole down from a surface level to a geological formation that contains the desired well fluids, and in the illustrative embodiment those are crude oil and natural gas. As the well is drilled, a well casing 34 is placed into the borehole to maintain its integrity over time. After the well casing 34 is built, a tubing string 56 is lowered into the well casing 34. The tubing string 56 is generally comprised of plural tubing sections that are interconnected with plural couplings 58, although continuous tubing strings are known in the art. A pump assembly (not shown) is attached to the bottom of tubing string 56. The down-hole pump is driven by a sucker-rod 54 that is located within the tubing string 56. The sucker-rod extends up to the surface level, and is terminated with the polished rod portion 54 to sealably engage the gland seal 62.

FIG. 2 also illustrates a conventional reciprocating drive unit 83, also referred to as a pump jack, which cycles the polished rod 54 up and down to drive the subterranean well pump (not shown). The drive unit 83 consists of a reduction drive with Pitman arm 82 coupled to a walking beam 80, which is supported on a Sampson post 84. A horse head 78 on the walking beam 80 supports a cable bridle 76 which is connected to the polished rod 54 by a carrier bar 74. These are well known terms of art. A wireless polished rod transducer ("WPRT") 72 of the present invention is temporarily clamped to the polished 54, and cycles up and down with the polished rod 54 during the test procedure. Alternatively, a horseshoe style strain gauge may be disposed about the polished rod at the carrier bar to sense changing compressive forces between the two.

A plunger lift well, discussed at length in the McCoy et al. U.S. Pat. No. 6,634,426 employs a plunger, or piston, within the well tubing sting. Since the well typically expels gas under formation pressure, a reciprocating pump is not employed. However, water and other liquids can accumulate in the well bore, and it is necessary to expel them. The plunger is utilized, driven by differential pressures in the casing and tubing string, to push liquid in the tubing string to the surface. After the liquid is cleared, the plunger falls back down the tubing string. An important test for determining the condition of a producing oil well is a bottom hole pressure build up test. The results of this test indicate the need for well stimulation, work over, or recompletion, as well as permit the determination of formation characteristics. Occasionally, pressure sensors can be placed directly at the formation level within the borehole for direct measurement of pressure. However, more frequently, the presence of pumping rods in the tubing prevents such direct measurement. In those situations, it is common to use acoustic techniques to determine the level of the fluid within the borehole, and calculate the bottom hole pressure estimating the density and depth of the fluid column and overlying gas. The systems and methods of the present invention are useful for gathering and processing such data.

Figure 3:
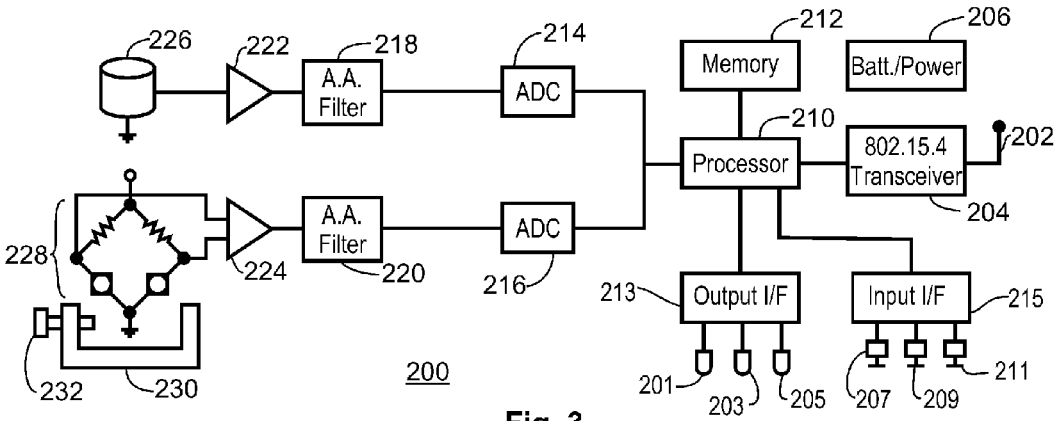
FIG. 3 is a side view drawing of a wireless polished rod transducer according to an illustrative embodiment of the present invention.

Reference is directed to FIG. 3, which is a functional block diagram of a wireless polished rod transducer ("WPRT") 200 according to an illustrative embodiment of the present invention. The wireless polished rod transducer is one type of wireless remote available to operators under the illustrative embodiments of the present invention. Attention is again directed to the McCoy et al. U.S. Pat. Nos. 5,406,482 and 5,464,058 U.S patents discussed in the Background of the Invention section. The illustrative embodiment of FIG. 3 advances the art with the use of a wireless transceiver 204 and certain advanced processing techniques and features to enhance and simplify well testing procedures, in particular, the gathering of dynamometer data in real time. The physical sensors of the WPRT 200 are an accelerometer 226 and a group of strain gauges wired in a Wheatstone bridge circuit 228 (collectively "strain gauge"). The accelerometer 226 detects acceleration in the up and down movement of the polished rod. The raw signal is amplified by amplifier 222 and filtered by anti-aliasing filter 218 prior to being digitally samples at a selectable predetermined rate, which may be 30 Hz, by analog to digital converter 214. The sampled acceleration signal is then coupled to processor 210. The strain gauge 228 is clamped to the polished rod by C-shaped clamp arm structure 230 and setscrew 232. The setscrew 232 is tightened to preload the bridge circuit 228 into an acceptable operating range of the strain gauge 228. As the polished rod cycles up and down, the tensile load changes and the strain gauge 228 detects minute changes in the rod diameter. This data is processed to determine the magnitude of the tensile load on the polished rod. The differential voltages across nodes the Wheatstone bridge 228 are amplified by differential amplifier 224 and are then filtered by anti-aliasing filter 220 before being sampled at a selectable predetermined rate, which may be 30, Hz by analog to digital converter 216. The sampled strain data is then coupled to a processor 210 in the WPRT circuit 200. It is preferable that the sampling rate of the accelerometer 226 and strain gauge 228 are the same, and that they are precisely synchronized so as to provide the most accurate sampled data for subsequent analysis, processing, and graphical presentation. Therefore, the ADC 214 and ADC 216 clocks may be synchronized so that the data sample sets precisely coincide in time.

The processor 210 in the WPRT 200 of FIG. 3 has access to memory 212 for temporary storage of sampled data, variables, reference values, unit identity, and program object code. An I.E.E.E. 802.15.4 compliant transceiver 204 is used as the physical layer communications link into a local wireless network for which the wireless base (discussed hereinafter) serves as network host controller. The processor 210 implements the higher communications protocol layers for packet assembly, addressing, and control functions, which will be more fully discussed hereinafter. The transceiver 204 interfaces to the radio network using an antenna 202. A rechargeable battery and power circuit 206 in the WPRT 200 provides power to the circuits discussed above. The illustrative embodiment WPRT 200 employs a function specific user interface that enable the user to enter commands via three key actuators 207, 209, 211 coupled to the processor 210 through an interface circuit 215. The user interface also includes three visual indicators 201, 203, 205, which are LED's in the illustrative embodiment, also coupled to the processor 210 though an interface circuit 213. In the illustrative embodiment, the actuators and indicators include an ON/OFF 201, 207; INSTALL pretension 203, 209, and ACQUIRE data 205, 211, which will be more fully discussed hereinafter. Other embodiments can incorporate other user interface functions, including higher resolution visual displays, matrix keyboards and so forth.

Figure 5:
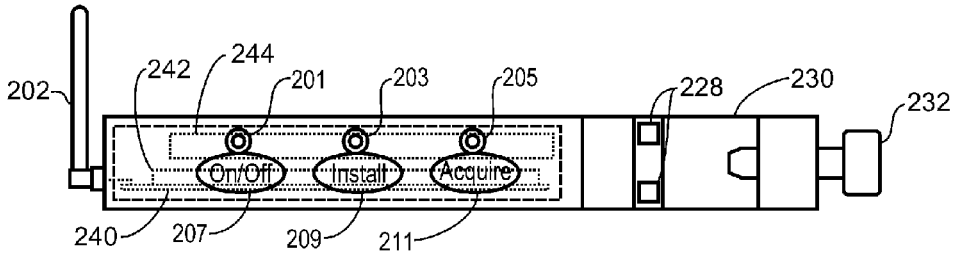
FIG. 5 is a functional block diagram of a wireless polished rod transducer according to an illustrative embodiment of the present invention.
Figure 4:
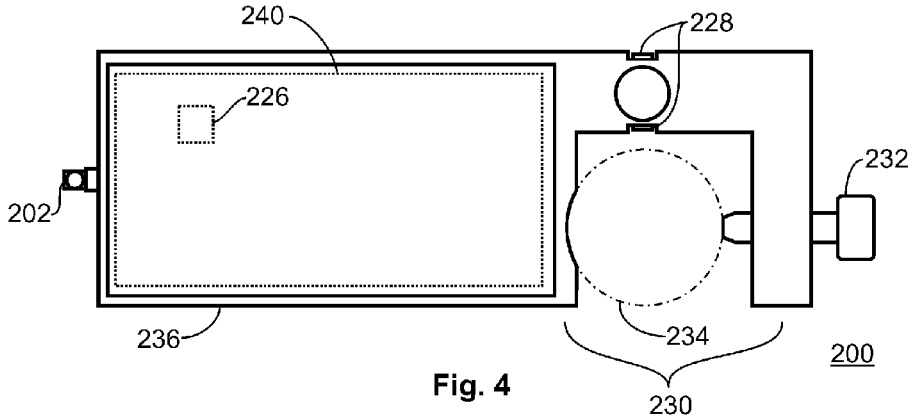
FIG. 4 is a top view drawing of a wireless polished rod transducer according to an illustrative embodiment of the present invention.

Reference is directed to FIG. 4 and FIG. 5, which are top view and side view drawings, respectively, of a wireless polished rod transducer ("WPRT") 200 according to an illustrative embodiment of the present invention. The structure of FIG. 4 and FIG. 6 correspond, in part, to the functions of FIG. 3. The WPRT 200 is fabricated as a single structural housing 236, machined from a suitable material such as stainless steel, to provide a rugged and unified device. One end of the device is formed in the aforementioned clamp arm 230 configuration, with a setscrew 232 provided to clamp the unit onto a polished rod 234 at the time a test is conducted. The strain gauge sensors 228 are locate along the clamp arm 230 to detect the strain forces applied to the polished rod 234, which change along with minute changes in the rod 234 diameter. The accelerometer 226 is fixed within the housing 226 of the WPRT 200 as well. The other end of the WPRT 200 frame comprises a cavity 240 for housing the aforementioned circuitry. A printed circuit board 242 and circuit components are located therein. The storage battery 244 is also locating in the cavity 240. The antenna 202 for the transceiver 204 extends out from the cavity 240. The ON/OFF 201, 207; INSTALL pretension 203, 209, and ACQUIRE data 205, 211 actuators and indicators appear on the exterior of the WPRT 200. The indicators 201, 203, and 205 are multi-color LEDs in the illustrative embodiment, and function as follows. The ON/OFF LED 201 is off when the power is off, and displays a slow green flash rate when on and ready. At power up, the battery status is indicated with a series of quick flashes, up to ten total, which correspond to the battery state. If an error condition occurs during use, the indicator 201 provides three quick red flashes. The INSTALL LED 203 is off when the unit is not being installed. When the INSTALL actuator 209 is pressed, the LED 203 provides three quick green flashes. As the set screw 232 is tightened, the LED 203 gives quick green flash when the pretension is too loose, quick red flash when the tension is too tight, and stead green when the tension is in the acceptable range. The ACQUIRE LED 205 is off when the unit is not acquiring test data. When the ACQUIRE actuator 211 is pressed, the LED 205 gives three quick green flashes. As the unit starts acquisition, the LED 205 gives a slow flash, then goes to a fast green flash during acquisition. If there is an error condition, the LED 205 gives three red flashes. Thus it can be appreciated that the WPRT is a single, compact, fully integrated remote unit for the illustrative embodiment system that does not require any cable interfaces, and that can readily be clamped onto a polished rod and travel together therewith.

The only occasional connection that needs to me made is to recharge the battery 244, through a battery connector (not shown).

Figure 6:
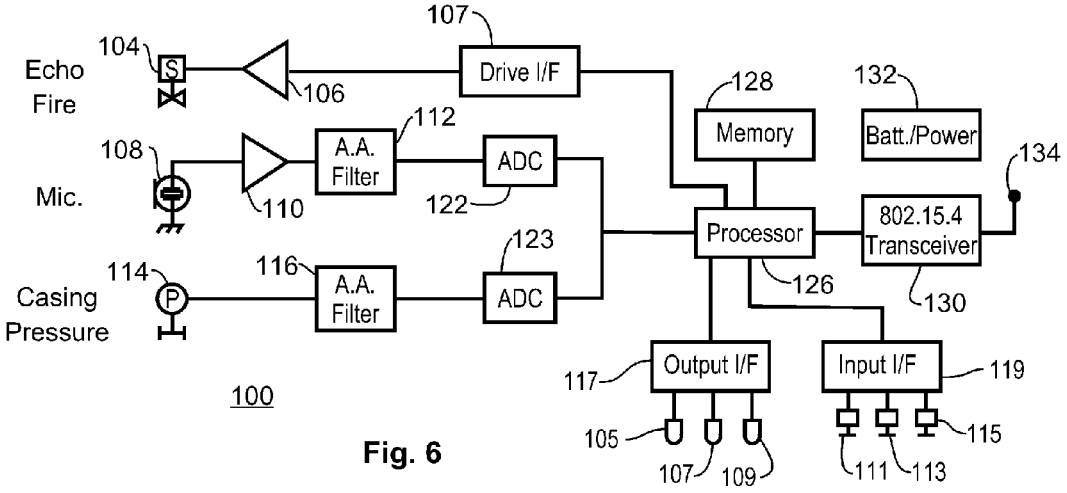
FIG. 6 is a functional block diagram of acoustic liquid level meter according to an illustrative embodiment of the present invention.

Reference is directed to FIG. 6, which is a functional block diagram of an integrated acoustic liquid level meter and wireless network remotes unit 100 according to an illustrative embodiment of the present invention. Since the acoustic liquid level meter wireless remote 100 releases a strong acoustic pulse to initiate a measurement, it is referred to as a "gun", and since it can be remotely activated, it is referred to as a remote fire gun. In the case of the wireless embodiment, it is referred to as a wireless remote fire gun, or "WRFG". Although, some embodiments can be manually fired by a technician. Since the WRFG 100 is coupled to the well casing annulus, it is also used as a host interface for a casing pressure sensor 114. The acoustic echometer 100 includes a solenoid valve 104 to release a pulse of precharged gas from a pressure canister 105 on demand. A piezoelectric microphone 108 us acoustically coupled to the casing interface to 'listen' to the initial pulse of gas and the return echo signals, and the microphone 108 produces an analog electrical signal proportional to the acoustic echo signal. The solenoid valve 104 is switch by a power drive circuit 106, which is coupled to a small signal interface 107 from a processor 126. The microphone 108 is coupled to an amplifier 110, which is coupled to an anti-aliasing filter 112, before being sampled by an analog to digital converter 122. In the illustrative embodiment, the microphone is sampled at 1 kHz to yield a finer resolution that most of the other sensor, which are typically sampled at 30 Hz. The casing pressure sensor 114 is coupled to anti-aliasing filter 116 before being sampled at 30 Hz by analog to digital converter 123. The sampled signals are then coupled to processor 126. The processor 126 has access to memory 128 for temporary storage of sampled data, variables, reference values, unit identity, and program object code. The processor also maintains a circular buffer of sampled microphone signals. The purpose of this is to process that data to detect the initial pulse of the compressed gas, so as to establish a timing reference for the subsequent echo signals. This is particularly useful in the case of a manual fired gun, where the software has no other information to determine when an echo test is being initiated. In this case, the detection of a gas pulse alters the buffer from a circular format to a data output format of collecting the desired data. An I.E.E.E. 802.15.4 compliant transceiver 130 and antenna 134 are used as a radio communications link into a local wireless network. A rechargeable battery and power circuit 132 in the WRFG 100 provides power to the circuits discussed above. The illustrative embodiment WRFG 100 employs a function specific user interface that enable the user to enter commands via three key actuators 111, 113, 115 coupled to the processor 126 through an interface circuit 119. The user interface also includes three visual indicators 105, 107, 109, which are LED's in the illustrative embodiment, also coupled to the processor 126 though an interface circuit 117. In the illustrative embodiment, the actuators and indicators include an ON/OFF 105, 111; ZERO 107, 113, and FIRE pulse 109, 115, which will be more fully discussed hereinafter. Other embodiments can incorporate other user interface functions, including higher resolution visual displays, matrix keyboards and so forth.

Figure 7:
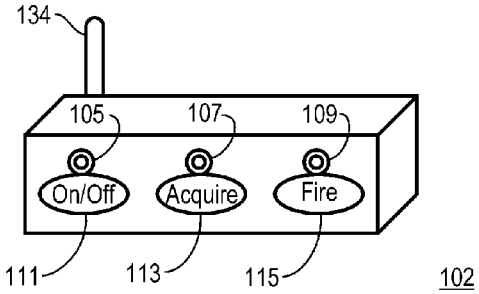
FIG. 7 is a drawing of a remote wireless sensor interface for an acoustic liquid level meter according to an illustrative embodiment of the present invention.

Reference is directed to FIG. 7, which is a drawing of a remote wireless sensor interface 102 portion for the wireless remote acoustic liquid level meter 100 according to an illustrative embodiment of the present invention. The interface includes the actuators and indicators including the ON/OFF 105, 111; ACQUIRE 107, 113, and FIRE pulse 109, 115, described about. The transceiver, processor, interface circuits, and battery circuits are also disposed within the interface, with the antenna 134 disposed on the exterior. The interface 102 is attached to the WRFG housing 100.

Figure 8:
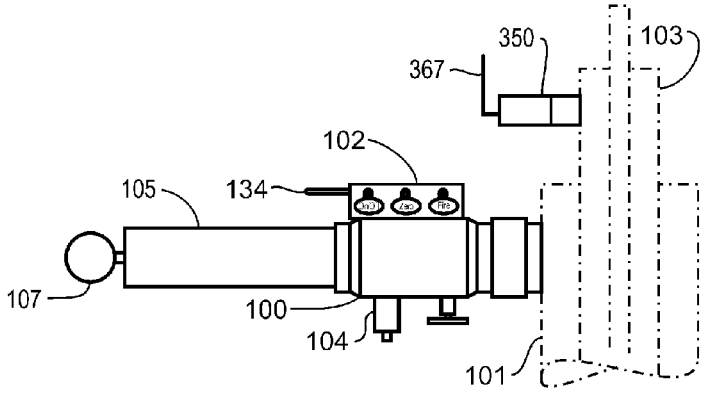
FIG. 8 is a diagram of an acoustic liquid level meter with wireless remote interfaced to a wellhead casing according to an illustrative embodiment of the present invention.

Reference is directed to FIG. 8, which is a drawing of the acoustic liquid level meter with wireless remote, WRFG, 100 interface with a wellhead casing 101 according to an illustrative embodiment of the present invention. FIG. 8 generally corresponds to the functions of FIG. 6. In FIG. 8, the WRFG 100 is acoustically coupled to the well casing 101 so as to conduct acoustic pulse and echo sounding measurements down into the well casing 101. The WRFG 100 includes the solenoid valve 104 and the piezoelectric microphone 108 (internal to the WRFG). A compressed gas reservoir 105 with a pressure gauge 107 extend from the WRFG 100. There is also a casing pressure sensor 114 (also internal to the WRFG 100) pneumatically coupled to the casing through the WRFG 100. All of the components are interface to the control circuit 102, which includes the interfaces, processor and wireless transceiver. Antenna 134 communicates within the aforementioned wireless network. All of these instruments are temporarily interface to the wellhead by plumbing connection at the time of testing. Additionally, FIG. 8 illustrates a tubing string 103 wireless remote pressure sensor 350 with antenna 367 that is pneumatically coupled to measure the tubing 103 pressure level. The separate wireless remote pressure sensor 350 will be more fully described hereinafter.

Figure 9:
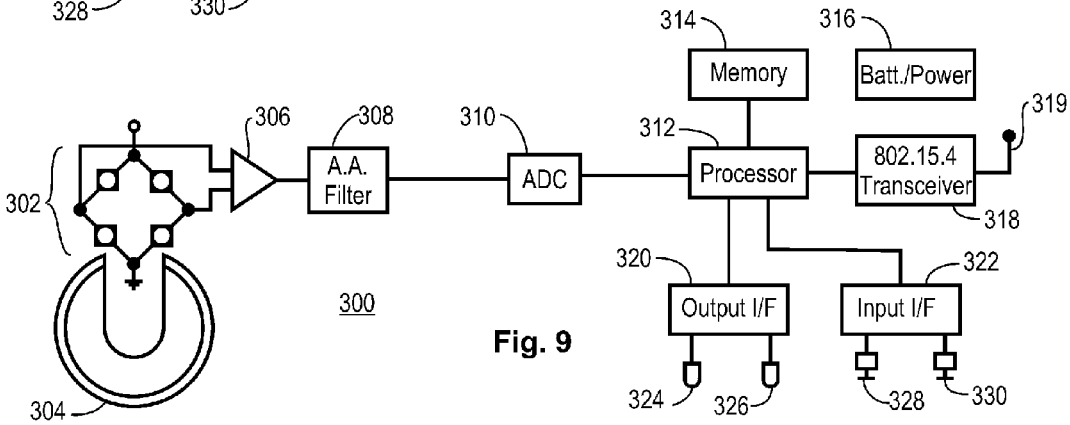
FIG. 9 is a functional block diagram of a horseshoe type strain gauge wireless remote according to an illustrative embodiment of the present invention.

FIG. 9 is a drawing functional block diagram of a wireless remote unit utilizing a horseshoe style strain gauge according to an illustrative embodiment of the present invention. The horseshoe stain gauge 304 is configured to insert between a rod and carrier on the mechanical drive unit of a sucker rod driven well pump. The horseshoe is thus compressed to varying degrees as the load on the rod cycles through each stroke of the pump. A strain gauge 302 is disposed in the horseshoe 304 so as to produce a corresponding stain signal, which is proportional to the force. The differential signal output from the bridge 302 is amplified by differential amplifier 306, and then filtered by anti-aliasing filter 308 before being digitally sampled by analog to digital converter 310. The sampling occurs at 30 Hz in the illustrative embodiment, however, this value is programmable up to 4 kHz. The sampled data is coupled to a processor 312, which executes a program to packetize the data, store the data in memory 314, and also couple packets to transceiver 318 for transmission into the wireless network. The memory 314 also stores other variables, program code, and so forth as needed. A rechargeable battery and power circuit 316 is also provided. The wireless remote 300 also employs a function specific user interface that enable the user to enter commands via two key actuators 328, 330 coupled to the processor 312 through an interface circuit 322. The user interface also includes two visual indicators 324, 326, which are LED's in the illustrative embodiment, also coupled to the processor 312 though an interface circuit 320. In the illustrative embodiment, the actuators and indicators include an ON/OFF 324, 328 and ZERO 326, 330. The ZERO function sets a bias offset with the pump is stationary, so that subsequent force data can be referenced to that value.

Figure 10:
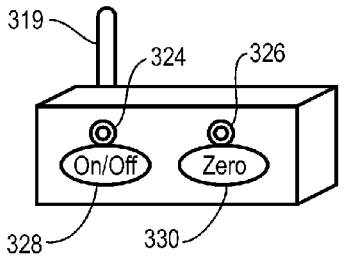
FIG. 10 is a drawing of the wireless remote for a horseshoe style strain gauge according to an illustrative embodiment of the present invention.

Reference is directed to FIG. 10, which is a drawing of the horseshoe style strain gauge wireless remote electronics module 300 according to an illustrative embodiment of the present invention. The module 300 presents the antenna 319 and the user interface, consisting of the ON/OFF 324, 328 and ZERO 326, 330 actuators and indicators. The electronics module can be integrated with the horseshoe sensor 304.

Figure 11:
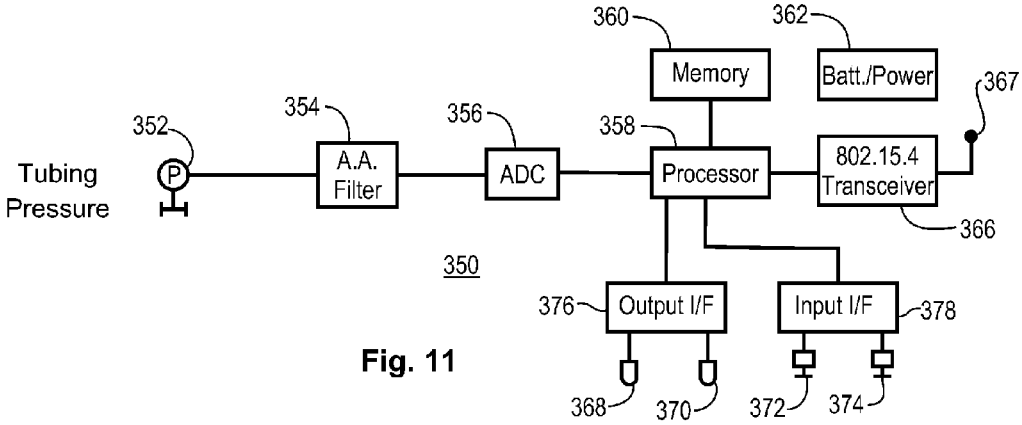
FIG. 11 is a drawing functional block diagram of a pressure transducer wireless remote according to an illustrative embodiment of the present invention.

Reference is directed to FIG. 11, which is a drawing functional block diagram of a pressure transducer wireless remote 350 according to an illustrative embodiment of the present invention. This remote 350 is also shown interfaced to the tubing string in the well in FIG. 8. In FIG. 11, the pressure transducer 352 is of conventional design, outputting a signal proportional to the input pressure to the device. The signal output from the pressure transducer 352 is filtered by anti-aliasing filter 354 before being digitally sampled by analog to digital converter 356. The sampling occurs at 30 Hz in the illustrative embodiment. The sampled data is coupled to a processor 358, which executes a program to packetize the data, store the data in memory 360, and also couple packets to transceiver 366 for transmission into the wireless network. The memory 360 also stores other variables, program code, and so forth as needed. A rechargeable battery and power circuit 362 are also provided. The wireless remote 350 also employs a function specific user interface that enables the user to enter commands via two key actuators 372, 274 coupled to the processor 358 through an interface circuit 378. The user interface also includes two visual indicators 368, 370, which are LED's in the illustrative embodiment, also coupled to the processor 358 though an interface circuit 376 In the illustrative embodiment, the actuators and indicators include an ON/OFF 368, 372 and ZERO 370, 374. The ZERO function sets a bias offset so that subsequent pressure data can be referenced to that value. The output interface 320 can also include other output functions. For example, a dry contact closure output, driven by a command received from the wireless base or the host software application, can be provided to drive auxiliary device, such as motors, lights, alarms, relays, solenoids, controlled devices and so forth. Similarly, the system design, radio protocol, and host software application can accommodate custom input device through the input interface 322. This is possible with all of the wireless remotes in the illustrative embodiments.

Figure 12:
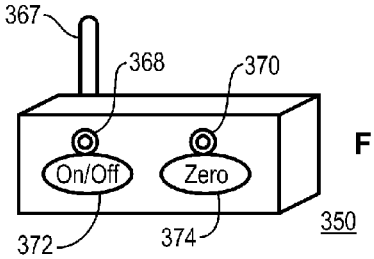
FIG. 12 is a drawing of a wireless remote for a pressure transducer according to an illustrative embodiment of the present invention.

Reference is directed to FIG. 12, which is a drawing of the wireless remote electronics module 350 for a pressure transducer wireless remote according to an illustrative embodiment of the present invention. The module 350 presents the antenna 367 and the user interface, consisting of the ON/OFF 368, 372 and ZERO 370, 374 actuators and indicators. The electronics module can be integrated with the pressure transducer 352 if desired.

Figure 13:
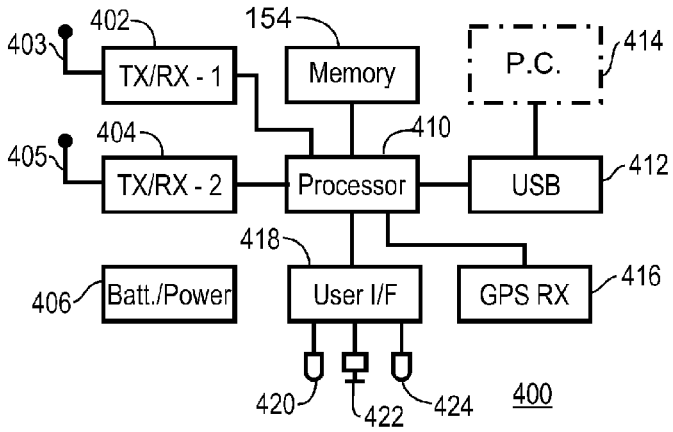
FIG. 13 is a functional block diagram of a wireless base computer interface according to an illustrative embodiment of the present invention.

Reference is directed to FIG. 13, which is a functional block diagram of a wireless base 400 computer interface according to an illustrative embodiment of the present invention. The wireless base 400 hosts the radio network under the IEEE 802.15.4 physical layer. The wireless base communicates with all the wireless remotes using the radio protocol and data protocols of the illustrative embodiment. The wireless base 400 also communicates with the host computer through a USB serial interface. Other computer and radio protocols, including proprietary protocols could also be employed. For example, the interface to the computer could be a parallel interface, Bluetooth, or WiFi, for example. Similarly, the radio network with the wireless remotes could be WiFi, WiMax, Bluetooth, other promulgated standard or a proprietary design as well. It is noteworthy that one aspect of the illustrative embodiment that is addressed with care is power conservation and battery life. The remotes are designed to operate for extended periods of time on a single battery charge. This issue is addressed in several ways. However, one fundamental decision is that of selecting a radio environment that is power efficient and has the requisite data bandwidth and reasonable component costs. Given the sampling rate range of up to 4 kHz and the typical number of sensors that might be needed at a well site, perhaps a dozen, the IEEE 802.15.4 specification was selected. This is the IEEE protocol standard employed in the ZigBee standard. While the illustrative embodiment system does not operate in compliance with the entire ZigBee standard, which defines several layers of a network communication protocol stack and certain system features, the illustrative embodiment does operate in compliance with the physical layer of the ZigBee protocol stack. This is significant in that the radio hardware components for ZigBee have been developed and are available off-the-self from several ZigBee system suppliers at competitive prices.

The IEEE 802.15.4 protocol is a specification for a suite of high level communication protocols using small, low-power digital radios based on an IEEE 802 family of standards for personal area networks. These are suitable for industrial equipment that requires short-range wireless transfer of data at relatively low rates, as compared to broadband telecommunication systems. The 802.15.4 defined data rate is 250 kbps, and is well suited for periodic or intermittent data or a single signal transmission from a sensor or input device. IEEE 802.15.4 chip vendors typically provide integrated radios and microcontrollers with between 60 KB and 256 KB flash memory at competitive costs. IEEE 802.15.4 operates unlicensed in the industrial, scientific and medical (ISM) radio bands of 2.4 GHz. The IEEE 802.15.4 network layer natively supports both star and tree type networks, and generic mesh networks. In the illustrative embodiments of the present invention, a star network topology is employed, which is implemented in a proprietary fashion using unique device identifiers, MAC addressing, as well as error detection and correction by requested retransmission. Every 802.15.4 network must have one coordinator device, tasked with its creation, the control of its parameters and basic maintenance. Within star networks, the coordinator must be the central node, and in the illustrative embodiments, this is the wireless base controller 400.

IEEE 802.15.4 builds upon the physical layer and media access control defined in IEEE standard 802.15.4 for low-rate WPANs. Because IEEE 802.15.4 nodes can go from sleep to active mode in 30 ms or less, the latency can be low and devices can be responsive. Because IEEE 802.15.4 nodes can sleep most of the time, average power consumption can be low, resulting in long battery life. The illustrative embodiments of the present invention takes advantage of this structure, employing a very low power sleep modes with infrequent beacons to the wireless base, and also a fast beacon mode that is still relatively power efficient. It is only during actual data acquisition mode that the wireless remotes consume significant amounts of battery power. In the 2.4 GHz band there are 16 IEEE 802.15.4 channels, with each channel requiring 5 MHz of bandwidth. The illustrative embodiment employs at least two of these radio channels. A first channel as a default configuration channel, and then a second channel is allocated for data acquisition. In the event the system detects poor radio performance based on transmission errors or signal to noise performance, alternate radio channels can be specified, selected, or automatically selected to improve radio link performance. Two separate transceivers are provided in the wireless base 400 so that both signaling function can occur simultaneously. In the 2.4 GHz band, 802.15.4 provides up to 250 Kbit/s data rates. The 802.15.4 radios use direct-sequence spread spectrum coding, which is managed by the digital stream into the modulator. Offset quadrature phase-shift keying (OQPSK) that transmits two bits per symbol is used in the 2.4 GHz band. Again, the raw, over-the-air data rate is 250 Kbit/s per channel in the 2.4 GHz band. Transmission range is between 10 and 75 meters (33 and 246 feet) and up to 1500 meters for IEEE 802.15.4 pro are possible, although it is heavily dependent on the particular environment. The output power of the radios is typically 0 dBm.

Thus, the functional block diagram in FIG. 13 illustrates two 802.15.4 transceivers 402, 404, with their respective antennas 403, 405. Both are interfaced to a central processor 410, which may be the native ZigBee processor. Power is supplied from a rechargeable battery and power circuit 406. A memory 154 is provided for executable code, data storage, variables, and other memory requirements. A USB communication port 412 is provided for interface to a host computer 414, as are known in the art. A host software application of the illustrative embodiment executes on the host computer 412, which functions will be more fully discussed hereinafter. The power circuit may drawn power from the host computer through the USB interface 412. Note that a GPS receiver 416 may be included in the wireless base, which is coupled to the processor 410. This enables the processor to obtain instant geographic coordinates for communications to the host computer. This is useful in correlating geographically oriented database records with the physical location of the base 400, such as locating well information for a present well analysis test. The host computer 414 provides a substantial control point and user interface for the wireless base 400 as well as the several wireless remotes. However, the wireless base 400 still comprises a limited user interface, include a reset button 422 and two indicators for On/Off 420 and Status 424, which are coupled to the processor through an interface circuit 418. In another aspect of the illustrative embodiment, the wireless base can operate in a stand-alone mode, separated from the host computer and host software application. This is referred to as a data-logger, and runs with the wireless remotes to gather and store test data. This is accomplished by transferring operating software, data, and variables from the host into the memory 154, then disconnecting the host allowing the wireless base 400 to run for memory. An external battery can be connected to power supply 406 to enhance running duration. The host computer and software application are used to set-up and start test, and later to download the collected data, but are disconnected during test. Power and heat are issues that are overcome vis-à-vis leaving a PC at the well site. Liquid level testing, repetitive, watching fluid level, during pumping, during static. Shut pump off, watch fluid levels refill, etc.

Figure 15:
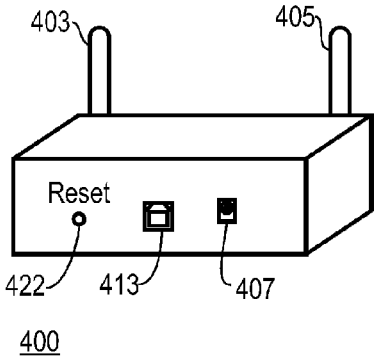
FIG. 15 is a back view drawing of a wireless base computer interface according to an illustrative embodiment of the present invention.
Figure 14:
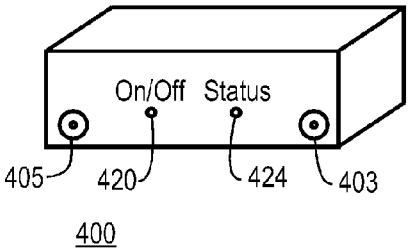
FIG. 14 is a front view drawing of a wireless base computer interface according to an illustrative embodiment of the present invention.

Reference is directed to FIG. 14 and FIG. 15, which is a front view drawing and a rear view drawing, respectively, of a wireless base 400 computer interface according to an illustrative embodiment of the present invention. The two antennas 403, 405 are illustrated, as well as the previously mentioned On/Off 420 and Status 424 indicators. The Reset actuator 422 enables the operator to conduct a hardware reset of the wireless base 400 if needed. In addition, a USB port physical connector 413 is provided for cable interface to the host computer (not shown). A DC power connector 407 is provided to the connection of an external power supply to facilitate rapid battery charging.

Figure 16A:
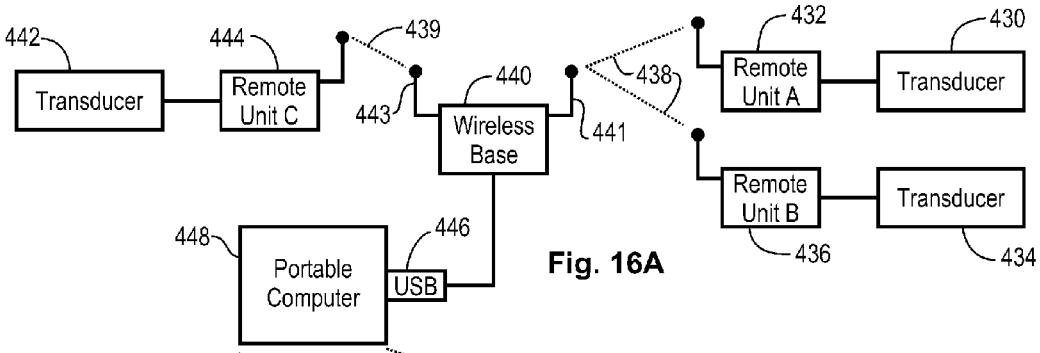
FIG. 16 is a system level functional black diagram of a wireless well performance monitoring system according to an illustrative embodiment of the present invention.
Figure 16B:
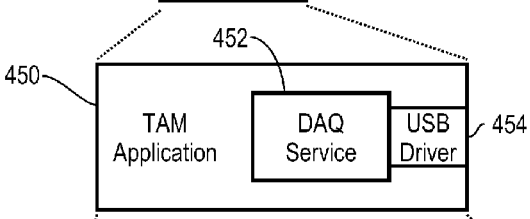
Figure 16C:
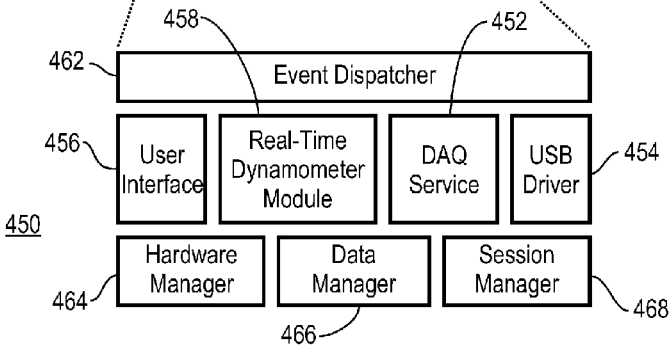

Reference is directed to FIGS. 16A, 16B, and 16C, which are system level functional block diagrams of a wireless well performance monitoring system according to an illustrative embodiment of the present invention. FIG. 16A illustrates the overall hardware and FIGS. 16B and 16C add the software structure integration of the illustrative embodiment. A portable computer 448, such as an IBM compatible personal computer running the Windows operating system, serves as the host computer for the system, running a software application 450 called the TAM Application, which is an acronym coined by the Echometer Company, Wichita Falls, Tex., for Total Asset Management. The wireless base 440 of the illustrative embodiment it interfaced to the host computer 448 through a USB interface 446. Within the host software application 450, a USB driver 454, manages the physical serial interface. The communications between the host software application and the wireless base are all data packet communications, so a Data Acquisition ("DAQ") Service 452 is provided in the host software 450 to manage the data packet assembly, routing, and addressing functions between the host application 450 and the wireless base 440.

As noted earlier, the wireless base in FIG. 16A includes two separate radio transceivers that enable it to simultaneously communicate on two separate channels through two antenna 441, 443. This capability can be used to maintain a configuration radio channel while simultaneously acquiring sensor data on another radio channel, or two data gathering channels can be operated simultaneously, thereby doubling the data bandwidth of the system. In FIG. 16, the first radio 441 sets up a first wireless network 438 transferring data from two wireless remotes, Remote Unit A 432 and Remote Unit B 436. Remote Unit A 432 is coupled to transducer 430 to sample data therefrom, and Remote Unit B is coupled to transducer 434 to sample data therefrom. Note that two separate wireless remotes 432, 436 operate simultaneously on a single radio channel. This is possible because the data channel is time division multiplexed into time slots that the system assigns to individual remotes. Synchronization is accomplished using a sync pulse transmitted from the wireless base 440. Wireless Remote Unit C 444 with its transducer 442 communicates with the other transceiver antenna 439 in the wireless base on the configuration channel, where status, configuration, and command functions are managed. Remote Unit C 444 could also be assigned to a second data channel through the second antenna 443, and begin data acquisition and transfer to the wireless base 440.

The TAM host software application 450 is further subdivided into plural functional elements in FIG. 16C. FIG. 16C is a diagram illustrates a broad view of what is inside the host software application 450. The USB Driver 454 and DAQ Service 452 were discussed above. It should be noted that the host application 450 can either process data from a live real-time test and acquisition process, or it can process stored data from earlier collected data. The processing in either case is essentially the same. If the test is a "live" test, the data stream and results are being acquired from the hardware through the DAQ Service 452. If the test is a "recalled" test, the data stream is recalled by the Data Manager 466 from previously stored data. Each test data set contains an Acquisition data set that is, or was, fed by the DAQ Service 452. The analysis contains several components that divide up the work of locating, processing and totaling pump strokes. The User Interface 456 has components that know how to display the results to the user and allow the user to interact with the analysis. The user can change settings in the analysis that will cause the results to be recalculated and redisplayed. A Recall Test component is responsible for loading historical tests from the Data Manager 452. The Acquire Test component is also responsible for setting up data acquisition with the DAQ Service 452 and creating a "live" test to fill with data from the hardware.

The DAQ Service 452 in FIG. 16B and FIG. 16C provides access to the hardware and supplies data streams from the hardware. The DAQ Service 452 runs primarily in the background, except for an Acquisition ("AQC") Manager portion that runs in the foreground for user access to the DAQ functions. As the name suggestion, the DAQ Service 452 provides data acquisition services. On one end it communicates with the wireless base unit 448 using the USB driver 454. On the other end is the interface to the host software application 450 through the ACQ Manager portion. The DAQ Service 452 provides a complement of data acquisition functionality to the host application 450, and provides a level of abstraction that hides the complexity needed to communicate and control the data acquisition devices.

The Real-time Dynamometer Module 458 in FIG. 16C is a processing function that takes data streams and presents the calculated results to the user through the User Interface 456. In the case of dynamometer testing, the input data to the Real-time Dynamometer Module 458 takes in load and acceleration data from the sensors and then outputs dynamometer plots and other useful results. There is a lot of processing and auto-processing that occurs, much of it subject to the McCoy et al. patents recited in the Background of the Invention section of this disclosure.

The Data Manager 466 in FIG. 16C is responsible for serializing data sets from and to disk storage. The Data Manager 466 is a central location to store. The Data Manager 466 has a structure that represents the data that will be persistent between application runs. Depending on the type of test that is being acquired, the Data Manager 466 maybe responsible for managing very large data sets where part of the data resides in memory and part of the data resides on disk. The Data Manager 466 is responsible for handling these processes in a seamless fashion so that the Real-Time Dynamometer Module 458 can seamlessly process any data set.

The Hardware Manager 464 in FIG. 16C functions to keep the User Interface 456 in sync with the current state of the system hardware, which can change from time to time. The Hardware Manager 464 maintains a cached list of the sensors, remembers the last sensors used at the well and knows which sensors the computer has used before. The Hardware Manager 464 is responsible for maintaining a list of sensor coefficients that go with each sensor. The user enters them once, and then the hardware manager saves them to disk for future sessions. The Hardware Manager 464 is also a central location that all User Interface 456 components can go to for a list of sensors or to configure the hardware.

The Event Dispatcher 462 in FIG. 16C is a generic tool for the various components in this system to notify each other about events. It is a communication mechanism for module A to tell module B that it needs to do some work. The Event Dispatcher 462 is used throughout the application to communicate between components. The Event Dispatcher 462 is used to be a gateway between background and foreground communication. This allows the DAQ Service 452 to notify the foreground that something in the background has happened and needs attention. The Event Dispatcher 462 is also used in the foreground to allow components to communicate with each other in a generic way.

The Session Manager 468 in FIG. 16C is responsible for coordinating the utility functions of the Data Manager 466, well data, Real-Time Dynamometer Module 458 and Hardware Manager 464. The Session Manager 468 is, in a sense, a manager of managers. The Session Manager 468 handles application events across different managers. The Session Manager 468 is also responsible for tracking the current "session" that contains the user's data. There is the concept of the "current session" or "current dataset" that the user is working in. All tests that are acquired go in this current session.

Figure 17:
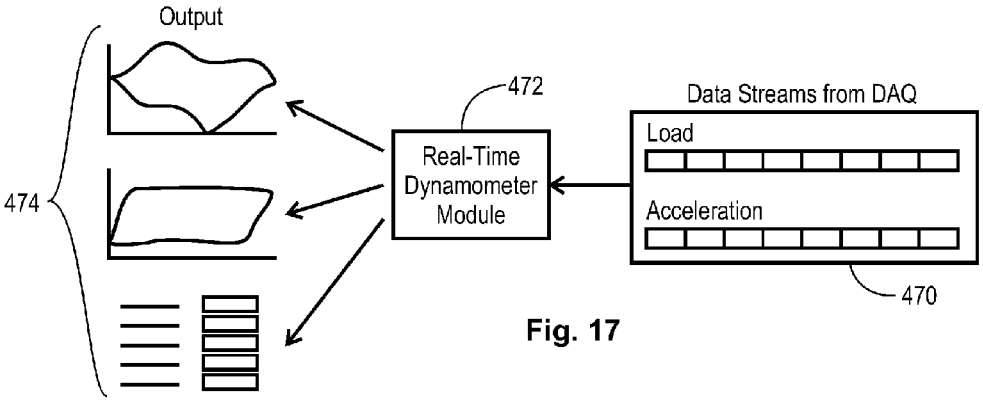
FIG. 17 is an information flow diagram for a wireless well performance monitoring system according to an illustrative embodiment of the present invention.
Figure 18:
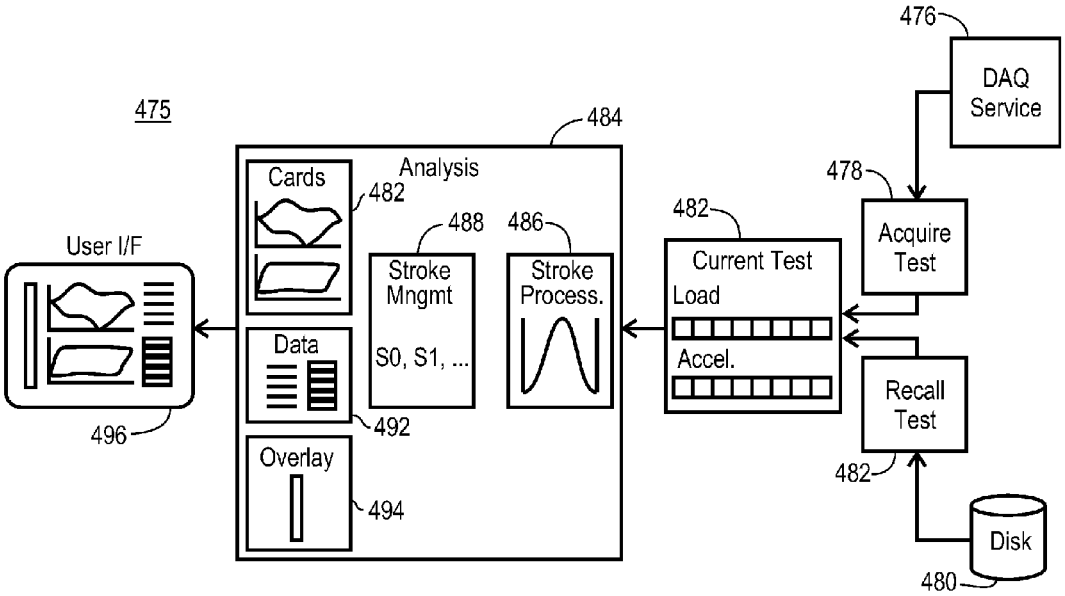
FIG. 18 is an information processing diagram for a wireless well performance monitoring system according to an illustrative embodiment of the present invention.

Reference is directed to FIG. 17, which is an information flow diagram for the Real Time Dynamometer Module 472 in the host application software according to an illustrative embodiment of the present invention. The DAQ Service provides real-time load and acceleration data 470 streamed from the wireless dynamometer sensor (not shown) and feeds it the Real Time Dynamometer Module 472 in the TAM Host Software Application. The data is processed to calculate and produce output 474 in various forms, including a real-time surface dynamometer dynagraph, a real-time down-hole pump dynagraph, and various tabulated data that relies upon the data stream. FIG. 18 presents an even more detailed view of a data processing schemes in the host software application.

Reference is directed to FIG. 18, which is an information processing diagram for a wireless well performance monitoring system 475 according to an illustrative embodiment of the present invention. FIG. 18 shows a broad view of what is happening inside and outside the real-time dynamometer module 484. The process includes a current test data set 482 component, an analysis process 464 component, a user interface 496 component to display the results, a recall test 482 component, and an acquire test 478 component. The test is a "live" test if the results are being acquired from the hardware in real-time through the DAQ Service 476. Otherwise the test has been "recalled" 482 by the data manager from a disk 480 or other storage media, and is historical. The current test 482 contains a streaming data set that is fed by the DAQ service 476. The analysis component 484 contains several internal components that divide up the work of locating, processing and totaling pump strokes. The User Interface 496 has components that arrange a convenient display of the results to the user and allow the user to interact with the analysis process. The user can change settings in the user interface 496 that will cause the results to be recalculated and redisplayed. The Recall Test 482 component is responsible for loading historical tests from the data manager. The Acquire Test 478 component is responsible for setting up data acquisition with the DAQ Service 476 and creating a "live" test to fill with data from the hardware.

With respect to FIG. 18, as well as other illustrative embodiments, the live acquire mode and historical recall mode are comparable yet different. The host software application has two distinct modes that it operates in, live acquire mode and recall mode. It is important to understand the difference that "acquire" mode refers to a real-time test that is presently using the hardware to supply data for calculations and "recall" mode, which operates on historical data that has been saved to disk and is being recalled from disk to be presently calculated and displayed. The same module and analysis routine can be used for both modes, but the source of the data is different. For acquire mode, the data is streamed from the hardware into a temporary test that the user can save or discard once the data has been acquired. The analysis routines look at this temporary test to calculate results. For recall mode, the data has already been collected and the analysis routine looks at the test that is loaded from disk and calculates results from this recalled test.

The data flow for recall mode in FIG. 18 is very similar to the acquire mode. The main difference is where the test comes from. In acquire mode the test is created by the Acquire Test component 478. In recall mode, the test is loaded from the data manager through the Recall Test component 482. The Recall Test component 482 then notifies the analysis to run and use the loaded test as the source. The data is already contained in the test and the analysis routine 484 uses the data to calculate results to be shown on the user interface 496. The user interface 496 reflects that the test shown on the screen is a "recalled" test and not a "live" test.

The analysis component 484 in FIG. 18 is the primary calculation and data processor of the dynamometer module 475. It processes real-time data 482 to determine strokes and calculates results for each stroke. There are five sub-components inside the analysis component 484 that have different responsibilities. Data moves through the analysis module 484 from right to left in FIG. 18, beginning with the stroke pre-processor 486.

The stroke pre-processor 486 in FIG. 18 is designed to take a stream of raw acceleration data and isolate whole pump stroke cycles ("strokes"). This process employs complex algorithms and filters accomplish this. The output of the stroke pre-processor 486 is a beginning and end index of each stroke, which is passed to the stroke management component 488 to be inserted in the list of strokes. The stroke pre-processing 486 keeps track of where it is in the raw data and just needs to be told when new data is available to be processed.

The stroke management component 488 in FIG. 18 is responsible for managing the list of strokes that have been identified by the stroke pre-processor 486. It is also responsible for computing the down-hole dynagraph plots for each stroke. This involves using the wave equations discussed in the McCoy et al. patents identified hereinbefore, to compute the down-hole dynagraph plot points from the surface dynagraph data. Once the surface and down-hole dynagraphs for each stroke are computed, other results are then calculated on a per-stoke basis or over a selected interval of strokes. The surface and down-hole dynagraph 482 calculation is a convenient way to get an at-a-glance view for each current stroke. The user might want to always see the most current stroke. In that situation, this computation simply notifies the foreground when the next stroke is computed and available. The user also might want to browse through some older strokes and get information like pump fillage from the stroke. This component calculates details about a stroke for the user. The data component 492 calculates averages and totals, and tracks things like the peak polished rod loading, which is a running peak. These calculations are composites of information from all of the strokes. This module 492 is responsible for doing the calculations when new stroke data is available from stoke management 488. The user might want to specify a certain range for the averages and totals, or they might look at everything. This is done at this level. The overlay module 494 generates a surface card overlay by gathering the required data needed to show a range of cards drawn overlaid on top of each other. The user might specify a certain range of cards or just see everything. They might want to see the most current card on top, or pull in some historical cards. All of this is handled by overlay component 494.

Figure 19:
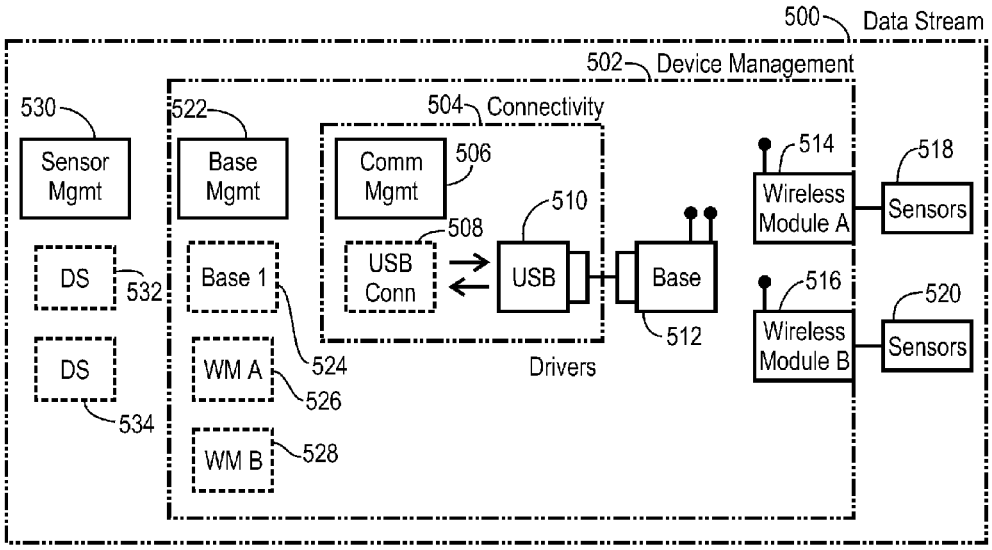
FIG. 19 is a software architecture diagram for a wireless well performance monitoring system according to an illustrative embodiment of the present invention.

Reference is directed to FIG. 19, which is a software and hardware integration architecture diagram for a wireless well performance monitoring system according to an illustrative embodiment of the present invention. In FIG. 19, the Data Streams box 500 represents the protocol communications layer, or "Comm-Mgmt". The Device Management box 502 represents the logical devices layer of the protocol, or "Base-Mgmt". The Connectivity Box 504 represents the sensor data stream layer of the protocol, or "Sensor-Mgmt". The separation of layers is significant for the DAQ Service as it manages information flow between hardware and software components in the system hierarchy. The DAQ service is layered by responsibility, so that each layer has a specific purpose. The architecture uses various messaging techniques for communication between various layers within the DAQ Service. Since each layer has its own processor thread, the communication must be "thread-safe" and asynchronous in nature. The Comm-Mgmt Layer 500 sends a message to the Base Mgmt layer 502. When the Base Mgmt layer 502 sees the message, it handles it and sends back a response message. The Base Mgmt layer 502 can choose to deal with the message at a time it chooses to and does not prevent the Comm-Mgmt Layer 500 from continuing to do whatever it deems the highest priority. In order to support this type of behavior a communication "backbone" between the layers is established such that they can pass messages to other layers including the Sensor Mgmt layer 504 as well as the user interface layer (not shown). This allows the layers to communicate but remain independent in execution from each other, and for the system to manage the processor time allocations and priorities.

Thus it can be appreciated in FIG. 19, that the Connectivity 504 functions include the physical USB port and its software driver 508, which are typically native to the personal computer used as the host processor. The Communication Management routine 506 of the illustrative embodiment serves to organize packets, addressing, and certain other hardware control functions, which are transferred with the USB driver 508. The Device Management 502 functions can transfers data with the Communications Management routine 506. The wireless Base 512 physically connects to the USB interface 510, and the two communicate within the constraints of the USB protocol. The wireless base 512 communicates through its two transceiver with any of plural wireless remote modules 514, 516. The radio communications physical layer follows the IEEE 802.15.4 protocol in transferring packet back and forth. On the host computer side of the Device Management 502 functions, a Base Management 522 routine controls communications with the virtual base 524, and the virtual wireless modules 526, 528. The Base Management 522 routine is thus unconcerned with the Connectivity 504 functions that support its communications needs. Thus the Base Management 522 routine is enabled to transfer data, commands, and controls with the wireless base 512, and the wireless remote sensors 514, 616 though access to the virtual machines 524, 526, 528, disregarding the layers of communications that support the exchange.

The purpose of the Device Management 502 functions is to support the system requirement to wirelessly communicate data, commands, and controls between the various sensors 518, 529 and the host software application software needs discussed with respect to FIG. 18. This is managed in FIG. 19 by the Data Stream 500 functions. Plural sensors 518, 520 gather data through transducers of various types, and this information is connected to a sensor interface in the wireless remote modules as sensor signals. This information is available to the Sensor Management 530 routine from the virtual digital sensors 532, 534 as the samples data converted in the Wireless Remote Modules 514, 516. Again, the Sensor Management 530 routine is unconcerned with the layers of communication implement in the illustrative embodiment, and simple view the source as the local virtual sensors 532. Of course, not all communications of information is fully end-to-end. Command, set-up, control, and other function calls can be directed to the various physical devices and software functions located throughout the systems.

Figure 20:
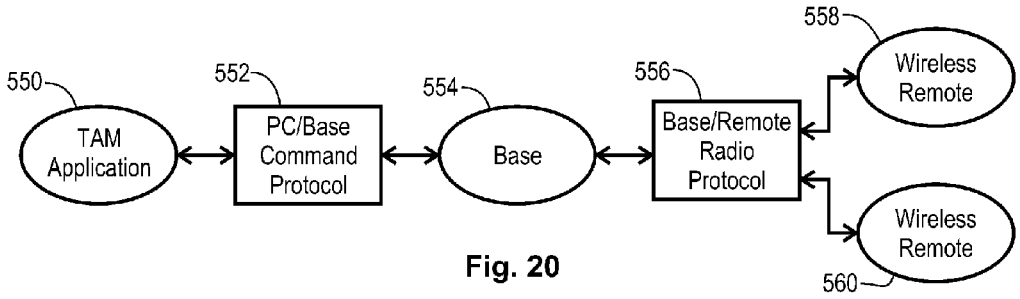
FIG. 20 is a system diagram for a wireless well performance monitoring system according to an illustrative embodiment of the present invention.

Reference is directed to FIG. 20, which is a system diagram for a wireless well performance monitoring system according to an illustrative embodiment of the present invention. This figure presents one fundamental illustrative embodiment of the structural arrangement of the functions and protocols. Plural wireless remotes 558, 560 gather information from a well fluid extraction process, as well as provide for user inputs and system control outputs at the well fluid extraction process. The wireless remotes 558, 560 communicate with the wireless base 554 using the system's base and remote radio protocol 556. The protocol supports the transfer of sensor signals from the wireless remotes 558, 560 to the base 554. In addition, the radio protocol 556 supports the transfer of user inputs and other system data, such as identifies and calibration information, from the wireless remotes 558, 560, to the base 554. The radio protocol also supports the transfer of commands and data from the base 554 to the wireless remotes 558, 560, including data to write to a visual output, operating parameters, identifiers, and calibration coefficients. The wireless base 554 communicates with a host software application, here referred to as the TAM Application 550 using a processor and base command protocol 552, referred to here as the PC/Base protocol 552. All of the aforementioned data, including sensor signals, inputs, outputs, data, identifiers, coefficients, and other information can be transferred between the TAM Application 550 and the base 554 using the PC/Base protocol 552. The base 554 is also operable to provide and conduit function for information flowing end-to-end between the TAM Application 550 and the wireless remotes 558, 560, and the base may function as a protocol converter between the PC/Base protocol 552 and the Baser/Remote protocol 556.

Figure 21:
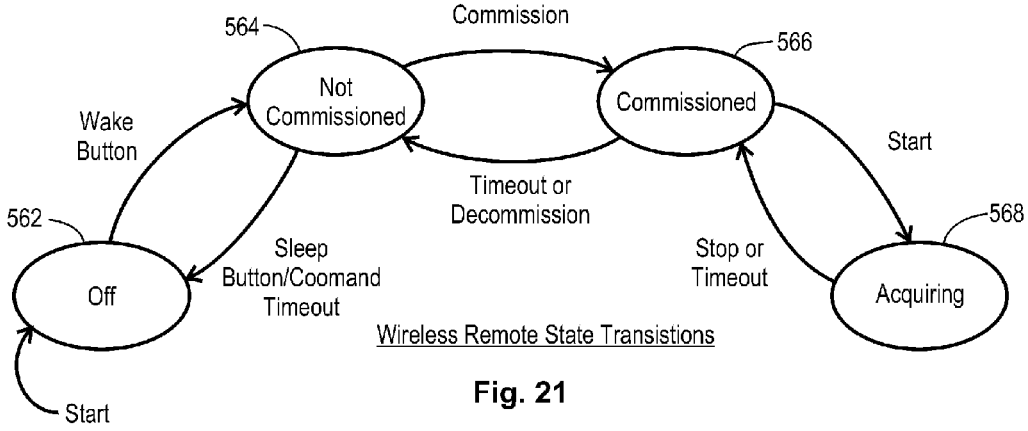
FIG. 21 is a wireless remote state transition diagram for a wireless well performance monitoring system according to an illustrative embodiment of the present invention.

Reference is directed to FIG. 21, which is a sensor state transition diagram for a wireless well performance monitoring system according to an illustrative embodiment of the present invention. In this illustrative embodiment, there is an emphasis on power management, particular in the wireless remote sensor units where long operating periods are desirable as well as compact battery size. A sleep mode of operation is employed such that the sensors wake up periodically to transmit a brief identity beacon, and then go back to an ultra low power sleep mode. The sensor also pauses for a moment to receive a reply command, should a base unit respond to the beacon, to enter and more active operating state. This can be accomplished within the constraints of the IEEE 802.15.4 radio hardware and protocol environment. This arrangement is also facilitated by the fact that the wireless base typically has a greater power reserve, in that it can draw power from the USB port interface, or other power source. Thus, the base can remain active to receive the spurious beacon signals from the several remotes that may be in radio range. In the illustrative embodiment, the sensors can be in one of four states, which include Off (powered down) 562, Not Commissioned 564, Commissioned 566, and Acquiring (actively sending sensor data).

The Off (powered-down) state 562 in FIG. 21 is the initial state for a sensor. In this state, the radio and processor within the sensor are turned off and it will not transmit a beacon or respond to signals from the base in any way. In order to get out of the Off state 562, a wake-up button on the wireless remote must be pressed, which may be an On-Off actuator. Actuating the wake button transitions the wireless remote into a Not Commissioned state 564. This activates the wireless remote to it lowest power consumption state, and in this state, the wireless remote has not yet been bound to a corresponding wireless base unit. In the Not Commissioned state 564, the sensor transmits a periodic identifying radio beacon, and will also wait briefly for a reply after each beacon. The wireless remote will also respond to a reply requests from any wireless base unit. It is significant to note that any wireless remote can operate with any wireless base through utilization of the beaconing and response processes. Once a base unit responds to the wireless unit beacon, the two become paired to operate together, at which time the remote is no longer responsive to commands from non-paired wireless bases. In a typical scenario, the reply from a wireless base will be a commission request indicating the identity of the wireless base. Thus, when a wireless remote receives a request from a wireless base to commission, the wireless remote will respond and become attached to that base, each recognizing the other by an identifier in the subsequent transmissions of packets. Periodic transmissions back and forth maintain the duration of the "attached" relationship. If the sensor has not received a message from a base after a specified timeout period, the sensor will reduce the rate at which it transmits beacons to a slower and slower rate until it reverts to a sleep state to conserve battery life. All of the foregoing beacons and transmissions occur on a default configuration channel in the 2.4 GHz IEEE 802.15.4 transceiver.

Continuing in FIG. 21, after receiving a commission request, the wireless remote enter the Commissioned state 566 and becomes bound to the wireless base. The wireless remote continues to transmits identity beacons, but at a faster rate, thus becoming more responsive to wireless base requests, but with the side effect of higher power consumption. Both the slow and fast beacon rates are programmable by the host software application in the illustrative embodiment. In the Commissioned state 566, the wireless remote is only responsive to requests from the attached base containing the requisite base identity, and will ignore requests for any other wireless base. After a predetermined and programmable timeout period of not receiving any requests from its attached wireless base, the sensor will revert to the Not Commissioned state 564. The transition to the Acquiring state 568 occurs upon receipt of a start command, which can be sent by the wireless base on command from the host software application.

Within the Acquiring state 568 in FIG. 21, the wireless remote is actively receiving sensor data, digitally sampling it, and sending packets of sampled data to the wireless base. Note that transition to the Acquiring state 568 typically includes a retuning of the transceiver in the wireless remote to a data channel in the IEEE 802.15.4 transceiver. This is done so that the second transceiver on the wireless base can remain active on the configuration radio channel to communicate with other wireless remotes. The sensor will remain in the Acquiring state 568 until it receives a stop command from the base, or until it fails to receive synchronization pulse from the wireless base. The synchronization pulse are broadcast by the wireless base at precise timing intervals, and serve as a timing reference to the digital sampling process. As has been discussed, the synchronization of sampling is important because it enables all of the plural sensors active in a give test process to report sensor data at the same instant in time. For example, the dynamometer readings include both force and acceleration, and these two values ultimately determine Cartesian plot data points on the dynagraph. If they are not precisely synchronized, then the dynagraph will appear distorted and irrational on close inspection. Similarly, pressure, temperatures, motor drive samples and even liquid level readings benefit from the precise synchronization made possible by the wireless base synchronization pulses.

Further in FIG. 21, note that the transitions to increasing levels of activity from Off 562 to Not Commissioned 564 to Commissioned 566 to Acquiring 568 each occur as a result of an intentional action by the user or a software command dictating an increased level of functionality. Similarly, the reverse of transitioning back down to lower levels of activity can occur by intentional action or command. However, it should be noted that since the radio link cannot be completely reliable, the system is designed to revert to lower levels of activity, and hence safeguards battery power by employing timeout periods whereby the sensor automatically reverts to the lower power state when expected synch pulses or replies are not received when expected. Similarly, the wireless base will decommission a wireless remote if it does not provide the expected signal in a predetermined time period.

Figure 22:
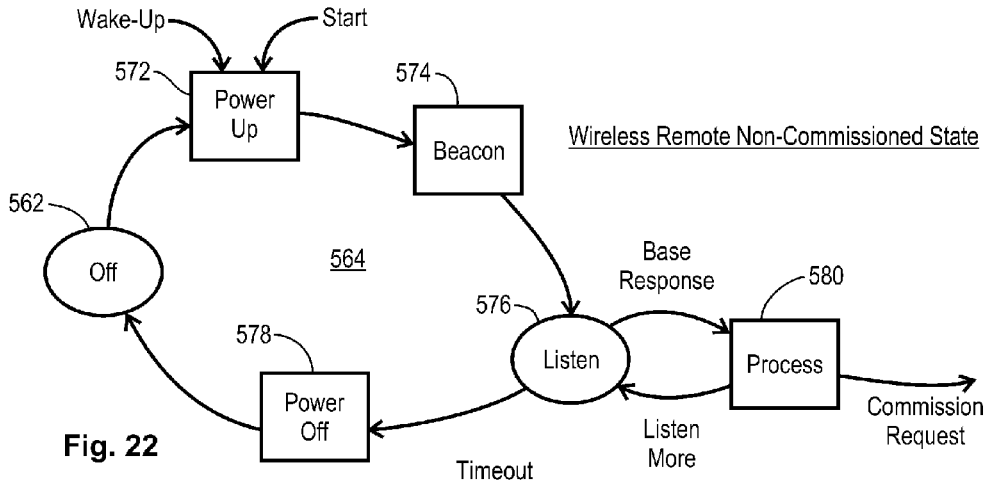
FIG. 22 is a wireless remote state transition diagram for a wireless well performance monitoring system according to an illustrative embodiment of the present invention.

Reference is directed to FIG. 22, which is a sensor state transition diagram for the Not Commissioned state in a wireless well performance monitoring system according to an illustrative embodiment of the present invention. This figure examines the Not Commissioned state 564 in further detail. Beginning in the Off state 561, the wireless remote powers up 572 either in response to an internal wake-up command or from the user actuating a start actuator on the wireless remote, which may be the On/Off or Acquire actuators in the illustrious embodiment. During the Not Commissioned state 564, the wireless remote's primary function is to transmit identity beacons and then listen briefly for responses. During the Off state 562, the wireless remote enters a low power mode to conserve battery life. After sleeping, the sensor wakes up 572 and then transmits and identity beacon 574. The identity beacon 574 is a broadcast packet that the wireless remote sends to let all wireless bases know that it is out there, and can be commissioned for use. After sending a beacon 574, the wireless remote will listen 576 for a predetermined period of time. If it does not receive a response from a wireless base, it will power off 578 until it is time to beacon again. If the sensor receives a base response in the Listen state 576, it will process the response 580 and respond to the wireless base that responded, and become commissioned thereto. A request from the base to change state to commissioned will cause the wireless remote to go to the Commissioned state. After processing a request from any base, the wireless remote will automatically go back to the Listening state 576 to check for another request before powering down. The listening period and timeout is determined by the firmware and timeouts.

Figure 23:
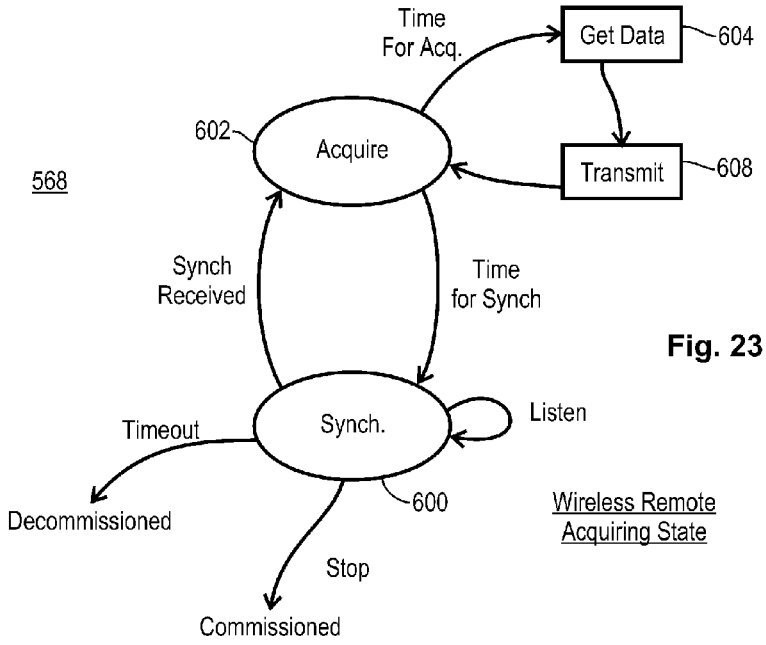
FIG. 23 is a wireless remote state transition diagram for a wireless well performance monitoring system according to an illustrative embodiment of the present invention.

Reference is directed to FIG. 23, which is a wireless remote state transition diagram for a wireless well performance monitoring system according to an illustrative embodiment of the present invention. This figure illustrates further detail with respect to the Acquiring state 568. In the Acquiring state 568, the wireless remote will start transmitting data to the wireless base in a continuous manner. This state is entered upon receipt of a Start command. Once in the Acquire state, the wireless remote listens for a synchronization pulse from the wireless base, which may contain other commands, and it does this by monitoring its radio receiver. When a synch is received, the wireless remote recognizes this as a precise timing reference and immediately transitions to Acquire mode 602. It then begins clocking its analog to digital converter to Get Data 604 from its sensor interface, and packetizes and Transmits 608 the data through the radio protocol to the wireless base. This process repeats at the predetermined sampling rate, which may be 30 Hz in the illustrative embodiment. Since the rate a which synch pulse are received is a predetermined interval, the wireless remote knows when it is time for each subsequent synch pulse to arrive and it reverts to the Synch mode 600 to listen for the next synch pulse. The synch pulse again aligns the precise timing of the sampling process, and it repeats indefinitely until one of two events occurs. The first event is the presence of a Stop command from the wireless base, transmitted within the synch pulse. If this is received, the wireless remote stops acquiring and returns to the Commissioned state. The second event is when the wireless remote returns to the Synch mode 600 to await the next synch pulse, but it is not received within a predetermined Timeout interval. In this case, the wireless remote has lost contact with its base so it is decommissioned to the Not Commissioned state, and begins to transmit periodic beacons.

Figure 24:
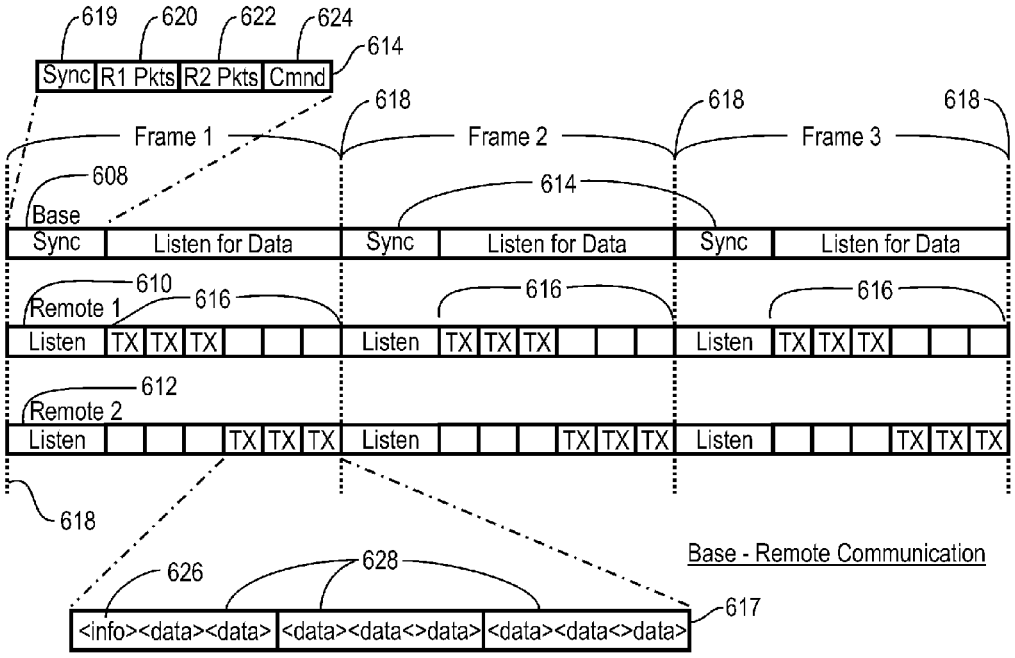
FIG. 24 is a data frame timing diagram for a wireless well performance monitoring system according to an illustrative embodiment of the present invention.

Reference is directed to FIG. 24, which is a data timing diagram for a wireless well performance monitoring system according to an illustrative embodiment of the present invention. This figure illustrates the data packet transmission timing relationship for the communications between a wireless base unit and two wireless remote units. Since the IEEE 802.15.4 transceivers are duplex, the system is capable of simultaneous two-way communications. However, it will be appreciated that issues related to receiver sensitivity in view of an adjacent transmitter need to be addressed in the protocol in order to provide avoid receiver desensitization and maintain optimum system performance. This is part of the reason that the illustrative embodiment multiplexes packet and transmitter operation over time. Another reason is that the system allows plural wireless remotes to transmit on the same frequency to the same wireless base unit, and therefore each is allocated specific time periods for transmission. A further reason is that the wireless base in the illustrative embodiment includes two transceivers, and it is important to time data communications so that the two separate radios do not interfere with one another. This is accomplished by sharing a common sync pulse between the two base transmitters so that all of the wireless remotes operating on both base transceivers are precisely synchronized. This arrangement also assures that all of the collected data samples are synchronized in time, and presented in a coherent manner all through the host computer processing and display functionality. Thus, it can be appreciated that controlled timing is essential to reliable system performance. In FIG. 24, a wireless base transmits and receives along data frame line 608. A first wireless remote transmits and receives along data frame line 610, and a second wireless remote transmits and receives along data frame line 612. Time is display along the horizontal, and is divided into frames at frame lines 618. Each Frame begins with the wireless base sync pulse 619 transmission.

In considering FIG. 24, it should be noted that in the Acquisition mode, the wireless remote communicates with the wireless base differently than when in the beaconing mode. Time is broken into frames (Frame 1, 2 and 3 in FIG. 24) and then each frame is broken into multiple time slots, whose duration and timing are programmable by the host software application depending on the number wireless remotes and the number of sensor connected to each remote. During configuration, the wireless remotes are programmed by the host application through the wireless base as to which time slots they are assigned to send data to the base, and during which time slots they need to listen for the base to send requests. Also, during acquisition, the base does not send commands or set the state of the wireless remote LED indicators like it does when the wireless remote is beaconing. Rather, the base interleaves commands during the time slot that is allotted for the base to send sync or stop commands. The wireless remote listens for sync, stop, or other commands during the time slot allotted for the base to send commands. This enables the system to continuously update the wireless remote LED indicator state even while acquisition mode is running. Furthermore, in the Acquisition state the wireless remote cannot respond to requests from the wireless base about its status. In order to monitor the performance of the wireless remote, status information is interleaved with transmitted data during acquisition. This requires the wireless remote to regularly insert an "info" packet into the stream of "data" packets that are being broadcast during its time slots. The information in the "info" packet includes key actuations, so that the wires base can be responsive to user inputs during the Acquiring mode. The wireless remote inserts the info packet at the beginning of its first slot for each frame.

The wireless base timing line 608 consists of repeating frames that begin at frame lines 618 with the synchronization pulse, or 'sync' pulse. As has been discussed, the sync pulse sets the timing reference for various components and timing functions in the system protocol. Sync is used as a reference for the remotes to time their respective transmission slots, and it is used as a timing reference for the exact instance the sampling converters are clocked, as well as a reference for the sampling frequency. In timing line 608, the sync transmission time period for the wireless base is followed by a period for listening (transceiver is in receive mode) to the several wireless remotes, which is referred to as listening for data. Again, note that the time periods and frame lengths are a programmable feature of the illustrative embodiment radio protocol. The sync transmission period 614 then repeats at the beginning of each data frame. The sync transmission period 614 actually includes plural data slots used for various purposes. The synchronization signal 916 leads the frame, and is repeated in every sync period 614. There are also command transmission frames for information and requests from the remotes. Remote specific commands can be sent to remote one 620 and remote two 622, or however many remotes are currently engaged in the radio protocol. These are commands that do or request specific things, such as controlling the state of the remote's indicators, requesting data such as calibration information, battery life, temperature and so forth. There is also a global command slot 624 in the sync period 614 for sending common commands to all the remotes, such as the Stop acquisition mode command. Following the sync period transmission 614, the wireless base listens with its receiver for the remainder of each frame.

In FIG. 24, each remote also has a data timing line, line 610 for wireless remote one and line 612 for wireless remote two. As the wireless base is configured for a specific data acquisition session, the host software application has the number of wireless remotes, the number and type of sensors connected to each, and the data sampling rates for each. The host software application then calculates the data throughput required for each, and assembles a suitable data framing arrangement for each remote. These include the frequency at which sync pulses are transmitted, which defines the frame duration, and groups of data slots with predetermined durations and start time offsets from the sync pulse. In the illustrative embodiment, sync repetition times range from 100 ms to 1 second. The overall duration of the frame periods are determined as well. This information is passed off to the remotes during a pre-acquisition configuration period. FIG. 24 illustrates a useful configuration for two wireless remotes. All of the remotes 610, 612 listen at the beginning of each frame for the duration of the sync period 614, and set their internal timing references as well as decoding and responding to commands sent by the base. The wireless remote transmission period 616 of each frame is divided into six data slots in this example, three for wireless remote one, and three for wireless remote two. Each remote is assigned an offset time to begin its data transmission and a duration during which it can transmit. The data transmission period 617 for remote two is magnified in FIG. 24 to show further details. The beginning of the first data slot from Remote 2 contains an information packet 626, which is were the remote responds to commands from the base or provides other system data during the acquisition process. The remaining data slots contain packets of sampled data 628 from the digital converters connected to the transducers. Each data packet is framed according to the radio protocol with source and destination addressing used to route information through the aforementioned communications layers. In addition, there is typically excess data transmissions space in the assigned data slots, and the remote can use this to retransmit packets that were received with errors, where the base made a prior request that they be retransmitted. The requests for retransmission follow an error detection process and are transmitted in the base sync periods 620, 622 in this embodiment.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A wireless dynamometer system for monitoring a sucker rod driven pump operating in a well fluid extraction process, which operates in conjunction with a computer, the system comprising:

a host software application running on the computer;

a wireless base having a base radio transceiver coupled to a communication port for interface to the computer;

a wireless remote having a housing with a clamp for clamping onto the sucker rod and moving together therewith, said clamp including a tension adjustment actuator to vary pretension of said clamp about the sucker rod;

an accelerometer fixed to said housing, which outputs acceleration signals representative of instant acceleration rates of the sucker rod, coupled to a first converter that digitally samples said acceleration signals at a first sampling rate to generate a stream of acceleration data;

a strain gauge disposed about said clamp, which outputs load signals indicative of instant loads on the sucker rod in accordance with a calibration coefficient, coupled to a second converter that digitally samples said load signals at a second sampling rate to generate a stream of load data, and wherein said strain gauge includes a pretension circuit that outputs a calibration signal indicating said clamp pretension is within an operating range;

a remote radio transceiver coupled to said first convertor and said second convertor, which communicates with said base radio transceiver in accordance with a radio protocol to communicate host commands from said host software application to said wireless remote and remote commands from said wireless remote to said host software application, and to transfer said stream of acceleration data and said stream of load data to said host software application, and wherein said pretension circuit is coupled to communicate said calibration signal to said host software application via said radio protocol, and wherein said host software application transmits a synchronization pulse to said wireless remote to initiate and synchronize said first sampling rate and said second sampling rate, and wherein said host software application processes said stream of acceleration data and said stream of load data to generate, and displays on the computer, a real time surface dynagraph, and calculates and displays a real time down-hole pump dynagraph.

2. The system of claim 1, and wherein:

said wireless remote includes an actuator coupled to said pretension circuit, wherein actuation of said actuator couples said calibration signal to said remote radio to transmit said calibration signal to said host software application, for display on the computer, thereby enabling visual confirmation said strain gauge pretension.

3. The system of claim 1, and wherein:

said base radio transceiver and said remote radio transceiver are frequency agile between a configuration radio channel and data transfer radio channel, and wherein said wireless remote operates on said configuration radio channel by default and changes to said data transfer radio channel upon receipt of a channel command from said host software application, through said wireless base radio transceiver.

4. The system of claim 1, and wherein:

said host software application adds said unique identification code to a list of remote unique identification codes, thereby making said host software application aware of said wireless remote.

5. The system of claim 1, and wherein:

said remote wireless transceiver periodically transmits an identity beacon that contains a unique identification code for said wireless remote, and wherein said base transceiver couples said unique identification code to said host software application, thereby making said host software application aware of the availability of said wireless remote, and wherein said wireless remote is subsequently addressed according to said unique identification code by said host software application.

6. The system of claim 1, and wherein:

said first sampling rate and said second sampling rate are programmable by said host software application, and wherein said host software application transmits a sampling rate command to said wireless remote to program said first sampling rate and said second sampling rate.

7. The system of claim 1, and wherein said synchronization pulse is referenced to a hardware timing circuit in said wireless base, thereby eliminating timing jitter and clock drift caused by software latency or clock instability.

8. The system of claim 1, and further comprising: a second wireless remote having a second remote radio transceiver that communicates with said base radio transceiver using said radio protocol, and having a sensor interface to receive a stream of sensor signals, and wherein said second wireless remote digitally samples said stream of sensor signals and communicates second sampled data to said host software application through said wireless base.

9. The system of claim 1, and wherein:

said host software application conducts further analysis of said sampled acceleration data and said sampled load data to generate a graphical animation of a down hole portion of the sucker rod driven pump.

10. The system of claim 1, and wherein;

said wireless remote includes at least a first actuator coupled to said remote radio transceiver, and wherein actuation of said actuator causes said wireless remote to transmit an actuation command to said wireless base within said remote portion of said timing frames.

11. The system of claim 10, and wherein;

said actuation command is coupled from said wireless base to said host software application and causes said host software application to send a begin acquisition host command to said wireless remote to begin acquisition and processing of said stream of acceleration data and said stream of load data sensor data.

12. The system of claim 1, and wherein said radio protocol establishes timing frames having a data portion for the transmission of said stream of acceleration data and said stream of load data, and a base portion for the transmission of host commands from said wireless base to said wireless remote, and a remote portion for the communication of remote commands from said wireless remote to said wireless base.

13. The system of claim 12, and wherein said host software application divides said data portion of said timing frames into plural remote data slots, and assigns a first remote data slot to said wireless remote for the transmission of said stream of acceleration data and said stream of load data, and reserves an additional portion of said data portion for additional wireless remotes.

14. The system of claim 12, and wherein;

said host commands include an acquisition command for said wireless remote to begin, and a cease acquisition command for said first remote to terminate, said digital sampling and communication of said stream of acceleration data and said stream of load data.

15. The system of claim 12, and wherein;

said wireless remote includes a visual indicator coupled to said remote radio transceiver, and wherein said wireless remote is responsive to receipt of a base command received in said base portion of said timing frames to activate said visual indicator, and wherein said base command originates in said host software application.

16. The system of claim 12, and wherein;

said host commands include a sampling rate command, which is sent to said wireless remote and defines said first predetermined sampling rate and said second predetermined sampling rate.

17. The system of claim 12, and wherein:

said first predetermined sampling rate and said second predetermined sampling rate are independently programmable by said host software application, and are communicated to said wireless remote through said wireless base using said base portion of said timing frames.

18. The system of claim 8, and wherein the wireless dynamometer system is further adapted to take acoustic echo readings through a well bore coupling in a well bore of the well fluid extraction process, the system further comprising:

an acoustic gun assembly having a gas pressure reservoir gated with a solenoid valve to selectively release a shock wave of gas pressure to the well bore interface port;

a solenoid drive circuit coupled to open said solenoid valve in response to a fire command;

a microphone acoustically coupled to the well bore interface port to receive echo signals resulting from said shock wave;

a microphone convertor coupled to output a digital microphone signal;

a gun assembly radio transceiver coupled to said microphone convertor and said solenoid drive circuit, and adapted to communicate with said base radio transceiver according to said radio protocol, and wherein said host software application communicates said fire command within said base portion of said timing frames to activate said solenoid valve to release said shock wave, and wherein said gun assembly radio transceiver communicates said digital microphone signal within said data portion of said timing frames, thereby providing echo signals for analysis by said host software application.

19. The system of claim 18, and wherein:

said host software application detects said shock wave of gas pressure within said digital microphone signal to establish a reference time for acoustic echo readings, also within said digital microphone signal.

20. The system of claim 18, further comprising:

a pressure transducer coupled to sense well pressure, and coupled to a pressure convertor that produces pressure data, which is communicated to said host computer through said radio protocol.

21. The system of claim 20, and wherein:

said host software application utilizes said digital microphone signal and said pressure data to calculate a pressure gradient of a gas column and liquid column in the well bore.

* * * * *